US006542118B2

(12) United States Patent
Lalezari et al.

(10) Patent No.: US 6,542,118 B2
(45) Date of Patent: Apr. 1, 2003

(54) ANTENNA APPARATUS INCLUDING COMPOUND CURVE ANTENNA STRUCTURE AND FEED ARRAY

(75) Inventors: Farzin Lalezari, Boulder, CO (US); P. Keith Kelly, Lakewood, CO (US); Ian S. Rumsey, Broomfield, CO (US); Anne Rice, Arvada, CO (US)

(73) Assignee: Ball Aerospace & Technologies Corp., Boulder, CO (US)

( * ) Notice: Subject to any disclaimer, the term of this patent is extended or adjusted under 35 U.S.C. 154(b) by 0 days.

(21) Appl. No.: 09/938,969

(22) Filed: Aug. 24, 2001

(65) Prior Publication Data

US 2003/0038745 A1 Feb. 27, 2003

(51) Int. Cl.[7] ..... H01Q 3/26; H01Q 3/02; H01Q 3/12; H01Q 13/00; H01Q 19/10

(52) U.S. Cl. ..... 342/368; 342/374; 343/779; 343/834

(58) Field of Search ..... 342/5, 11, 368, 342/374; 343/755, 775, 779, 781 R, 781 P, 781 CA, 834–840

(56) References Cited

U.S. PATENT DOCUMENTS

| | | | | | |
|---|---|---|---|---|---|
| 3,852,765 | A | * | 12/1974 | Bresler et al. | 343/781 R |
| 3,887,926 | A | * | 6/1975 | Schwartz et al. | 342/374 |
| 4,100,548 | A | * | 7/1978 | Hemmi et al. | 342/374 |
| 4,250,508 | A | * | 2/1981 | Dragone | 343/779 |
| 4,755,826 | A | * | 7/1988 | Rao | 343/781 P |
| 4,977,407 | A | * | 12/1990 | Crane | 343/755 |
| 5,971,551 | A | | 10/1999 | Winston et al. | 359/868 |
| 6,043,779 | A | | 3/2000 | Lalezari et al. | 342/371 |
| 6,215,452 | B1 | * | 4/2001 | Chandler et al. | 343/779 |
| 6,236,375 | B1 | * | 5/2001 | Changler et al. | 343/779 |
| 6,396,449 | B1 | * | 5/2002 | Osterhues et al. | 343/755 |

* cited by examiner

*Primary Examiner*—Thomas H. Tarcza
*Assistant Examiner*—Fred H Mull
(74) *Attorney, Agent, or Firm*—Sheridan Ross P.C.

(57) ABSTRACT

An antenna apparatus that includes a beam control system and a beam collimating system having a compound curve antenna structure is provided. The compound curve antenna structure can be two-dimensional or three-dimensional. In one embodiment, the curve is parabolic and the compound curve antenna structure includes first and second parabolic reflector sections that are spaced from each other. A feed array of the beam control system is disposed therebetween at the base ends of the two parabolic reflector sections. When the compound curve antenna structure is three-dimensional, the two parabolic reflector sections are part of a body of revolution. The control system also includes memory storage that stores predetermined data related to controlling activation of each of a plurality of feed elements of the feed array. The predetermined data is based on information obtained using a reference beam with the compound curve antenna structure. In that regard, reflections and contact of EM radiation of the reference beam are monitored for a number of different scan angles. Based on the identities of the particular feed elements that are involved or receive EM radiation associated with the reference beam, determinations are made regarding the content of the predetermined data to be stored to be subsequently used in controlling activation of desired feed elements in generating a transmit beam or receiving a return beam at a desired angle of a number of scan angles.

32 Claims, 19 Drawing Sheets

FIG. 1
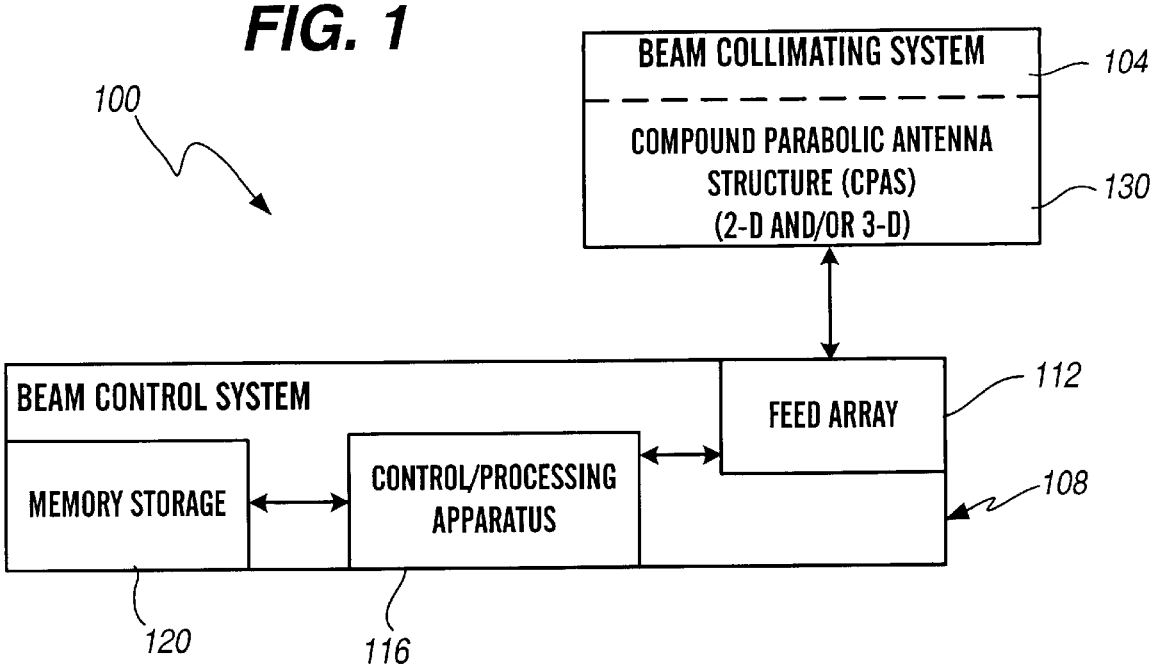
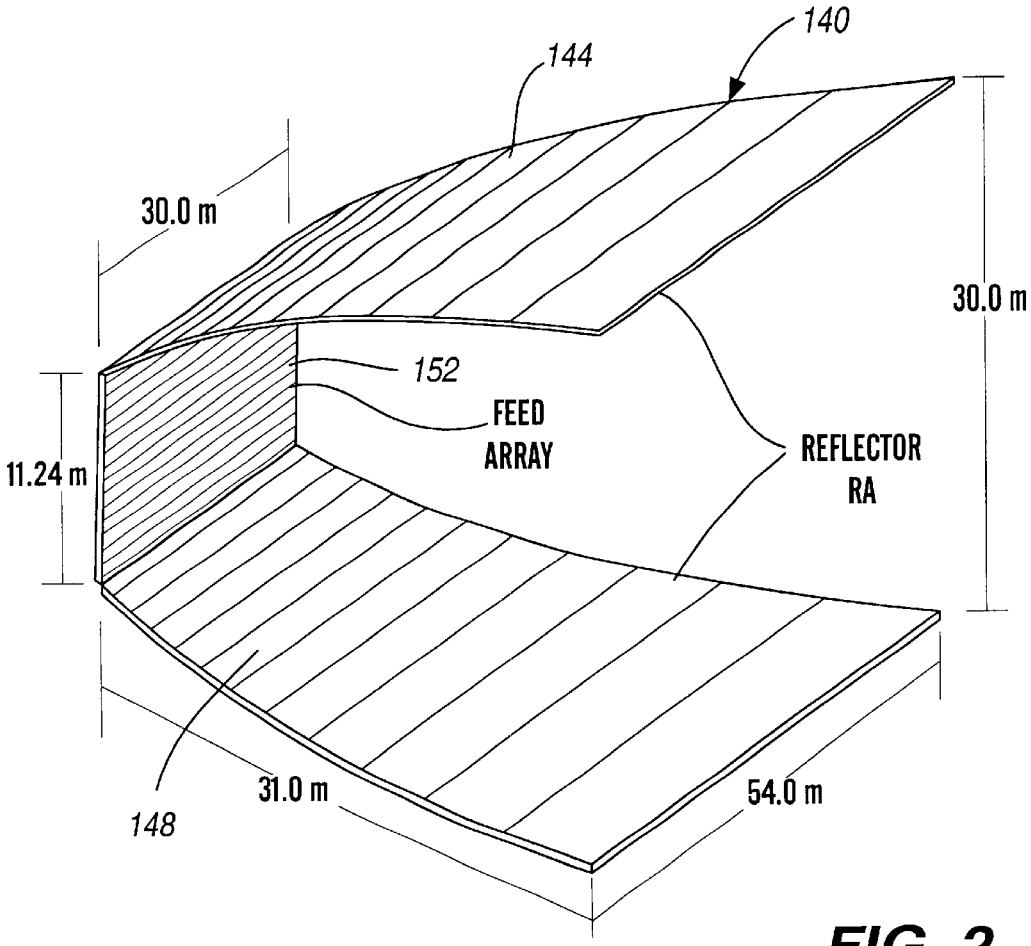
FIG. 2

FIG. 15
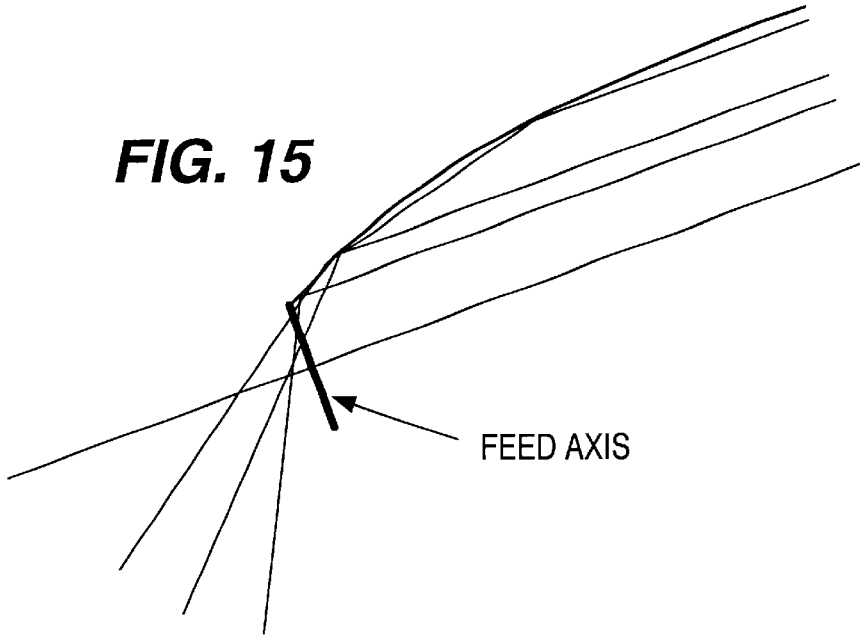
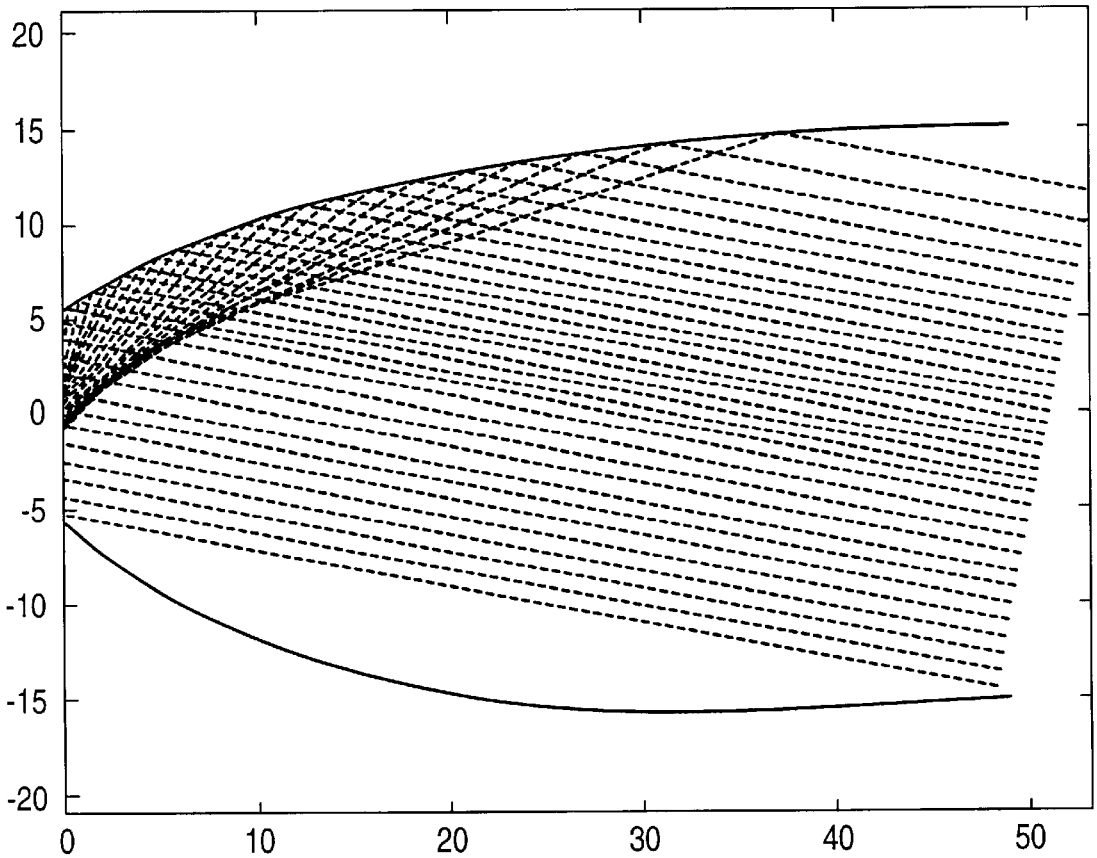
FIG. 16

ANTENNA APPARATUS INCLUDING COMPOUND CURVE ANTENNA STRUCTURE AND FEED ARRAY

FIELD OF THE INVENTION

The present invention relates to an antenna apparatus including a feed array and, in particular, to an antenna apparatus that includes a compound curve antenna structure for imaging purposes.

BACKGROUND OF THE INVENTION

Antenna systems with a reflector or collimating unit are well-known that send a transmit beam and receive a return beam in order to obtain desired information based on the contents of the return beam. A variety of such imaging systems have been devised that rely on a specifically shaped beam collimating unit, such as a parabolic-shaped reflector. Outputs from a feed array are applied to a reflector or other collimating unit to generate the transmit beam having a desired direction. A receive beam or the return beam is received by the collimating unit and applied to the feed array from which useful information can be obtained by suitable processing.

In designing the antenna system, certain key parameters are taken into account including size, the number of components, cost, gain and field of view. Generally, as the number of antenna components increases, the cost of the antenna system becomes greater. The gain of the antenna system is typically improved with a larger collimating assembly, such as a reflector or lens. However, this means a greater size and usually an increased cost. Expanding the field of view or scan range of the antenna system also means a larger feed array of energizing elements which results in a higher cost. Additionally, it is generally desired to have a high instantaneous bandwidth, while avoiding any increase in cost, size or weight of the antenna system.

When designing an antenna system, numerous and complex factors must be considered to arrive at an acceptable transmit/receive antenna system. It would be beneficial, therefore, to provide an antenna system that more advantageously balances these numerous factors whereby a desired or appropriate gain and field of view, for example, are achieved, while optimizing certain parameters such as instantaneous bandwidth and reducing others, such as size, cost and weight. Such an antenna system should be able to generate a transmit beam and process a return beam having useful information to be analyzed, while constituting an optimal design that includes a unique collimating assembly and accompanying feed array.

SUMMARY OF THE INVENTION

In accordance with the present invention, an antenna apparatus is provided having a beam control system and a beam collimating system in which the beam collimating system is characterized by having a compound curve antenna structure. The compound curve antenna structure can be two-dimensional or three-dimensional. The beam collimating system can include one, or more than one, compound curve antenna structure(s). The compound curve antenna structure includes at least first and second curved reflector sections. These two curved reflector sections can be located symmetrically about a defined reflector axis. The first curved reflector section is spaced from the second curved reflector section. When the compound curve antenna structure is three-dimensional, these two sections are part of a body of revolution. The two compound curved reflector sections have an aperture end and a base end. In at least the two-dimensional configuration, the feed array of the beam control system is disposed between these two reflector sections and adjacent to their base ends. Preferably, the first and second curved reflector sections are parabolic cylindrical reflectors, although other compound curved reflector sections might be used, such as hyperbolic, elliptical or other multi-curved configurations.

The feed array has a number of feed or energizable elements that, when energized, control generation of a transmit beam and/or control receipt/recovery of a return beam that can be, but need not be, based on the transmit beam. The return beam contains useful information related to an object or location of interest. The information associated with the return beam can be analyzed or processed in order to present or provide it in an intelligible form. The transmit and return beams can be controlled to scan through a range of angles that constitutes the field of view for the antenna apparatus, particularly using the beam collimating system which includes the compound curve antenna structure. With regard to such scanning of these beams, the feed elements of the feed array are selectively activated or energized to cause such beams to move in one or both of azimuth and elevation. Significant to the present invention, such control of the energization of the feed elements for an antenna apparatus having a particular compound curve antenna structure is based on predetermined data or other information stored in memory storage of the beam control system. In the two-dimensional compound curve reflector structure embodiment, the predetermined data relates to identification of reflections, and information related thereto, on the first and second curved reflector sections, together with reflections that strike feed array elements directly without first contacting the first and second curved reflector sections. By way of example, depending on the particular scan angle of the range of scan angles associated with the particular compound curve antenna structure, the receive or return beam may reflect from one or both of the first and second curved reflector sections and then strike one or more of the feed elements of the feed array. On the other hand, there may be no such reflections associated with at least some of the electromagnetic (EM) radiation of a return beam, which EM radiation strikes the one or more feed elements directly. In order to properly and accurately control the processing of a return beam at a desired scan angle, it is necessary to use the predetermined data related to reflections: (1) on portions of the compound curve antenna structure and (2) in direct contact with the feed array, in controlling which feed elements should be energized for a particular scan angle. More specifically, for a particular configured compound curve antenna structure in communication with an appropriate feed array (e.g., reference feed array), a reference beam, which emulates a return beam, can be directed to the compound curve antenna structure at a known scan angle. The reflections or striking/contacting of rays of the reference beam are observed in connection with identifying the specific feed elements that receive such rays. Based on such observations, the predetermined data associated with that particular scan angle is found and can be stored. Then, when that particular compound curve antenna structure, or one that is equivalent thereto, is utilized, the identified feed elements can be energized in accordance with the predetermined data that was stored based on use of the reference beam and the reference feed array.

In conducting the analysis related to a reference beam for a particular three-dimensional compound curve antenna structure, contributions of successive reflections on the structure are determined related to the total power collected by the feed elements of the feed array. In one embodiment, the feed distribution is considered to be converged or finished when the power delivered by the final reflection falls below a predetermined percent (e.g. 1%) of the total power collected from all collections. With regard to conducting the analyses for a number of reference beams at different scan angles for a particular compound curve antenna structure, a device (e.g., including software) can be employed that monitors the simulated, for example, EM radiation (electromagnetic (EM) fields or RF signals) of the reference beam in conjunction with any of its reflections. In particular, where such EM radiation contacts reflector portions and which feed elements are contacted by EM radiation are monitored.

With respect to the properties and/or operation of the antenna apparatus, certain key aspects are noted when utilizing the compound curve antenna structure. For a particular scan angle during scanning, as the scan angle increases towards a maximum angle of scan, which constitutes the outer edge of the field of view, the number of feed elements that are energized to control the antenna beam becomes less. When the compound curve antenna structure is two-dimensional, it has two focii. The two focii are located at the base ends of the two curved reflector sections. At the maximum angle of scan of the antenna beam, substantially all feed elements that are energized are located adjacent to both an end of the feed array and an end of one of the first and second curved reflector sections. Relatedly, as the angle of scan associated with the antenna beam moves away from the maximum angle of scan, the greater the number of feed elements that are energized to provide the antenna beam.

When the compound parabolic antenna structure is three-dimensional, the return beam can have a single linear polarization resulting from a dual-polarized feed provided during generation of the transmit beam on which the return beam is based. Relatedly, the feed array independently controls two orthogonal polarizations in communicating with the three-dimensional compound curve antenna structure. In one preferred embodiment, there are a number of three-dimensional compound curve antenna structures that are arranged in an array. By using this configuration, a higher bandwidth, particularly a higher instantaneous bandwidth, is provided whereby relatively more information is obtainable in a relatively less period of time.

Based on the foregoing summary, a number of salient features of the present invention are recognized. An antenna apparatus can be provided that reduces the size, weight and cost of a control/processing system including a feed array for a desired or given gain and field of view associated with a particular beam collimating system that includes a compound curve antenna structure. Relatedly, the scan range or field of view that can be achieved is greater than that for non-compound curve antenna structures, such as one-dimensional reflectors or lenses that can be used with sizes of feed arrays comparable to that utilized in the present invention. Importantly, the present invention requires a two-dimensional or three-dimensional antenna structure in combination with a feed array disposed at a predetermined position relative to this structure. As a result, a relatively higher gain with a relatively increased field of view can be obtained while reducing the cost, weight and size thereof over antenna designs that do not have a compound curve antenna structure.

Additional advantages of the present invention will become readily apparent from the following discussion, particularly when taken together with the accompanying drawings.

BRIEF DESCRIPTION OF THE DRAWINGS

FIG. 1 is a block diagram of the antenna apparatus that includes either a two-dimensional and/or three-dimensional compound curve antenna structure (CCAS);

FIG. 2 is a diagrammatic representation of a two-dimensional CCAS;

FIG. 15 is a diagrammatic representation illustrating that the path lengths of reflected radiation first increase linearly and then decrease linearly as the EM radiation moves toward the center of the feed axis of the feed array;

FIG. 16 illustrates a field path distribution for a 11° incidence angle;

DETAILED DESCRIPTION

Figure 3:
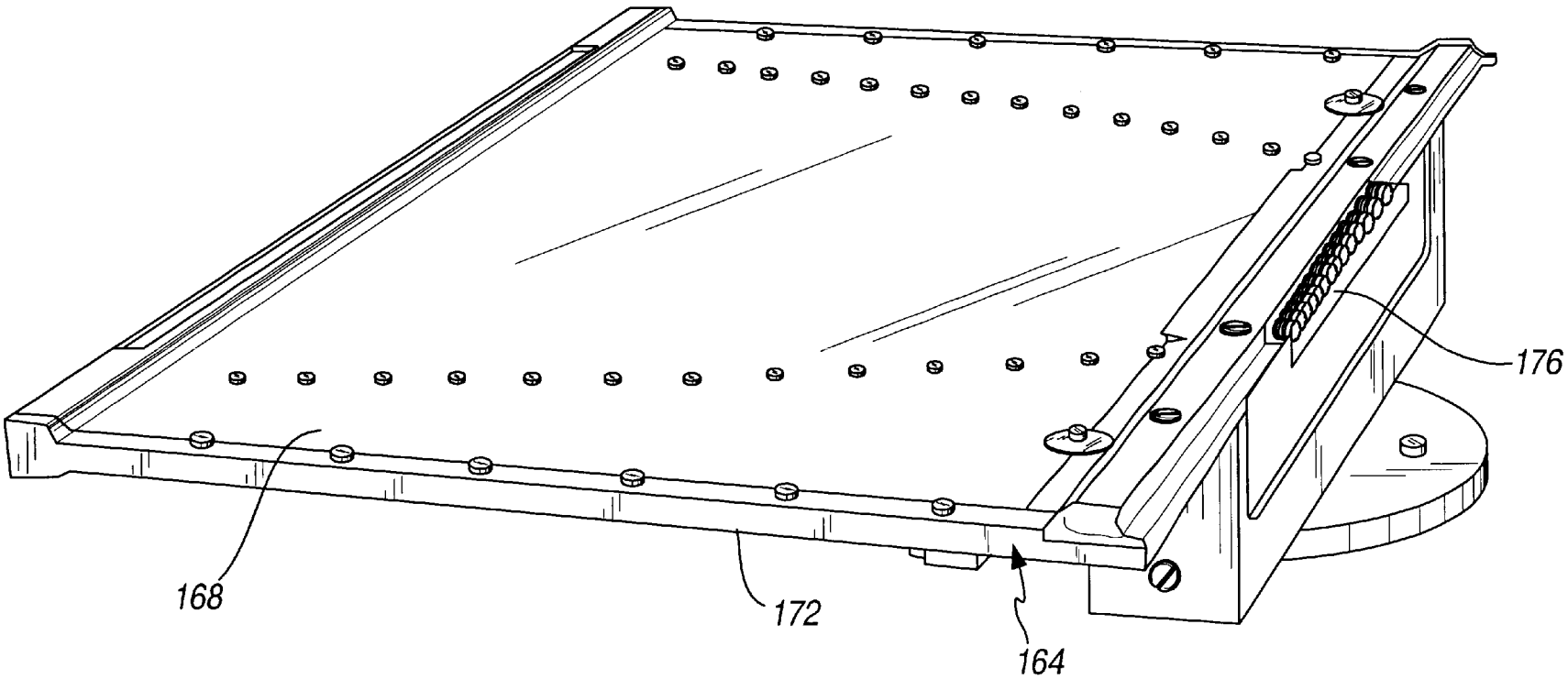
FIG. 3 illustrates one embodiment of a two-dimensional CCAS with a housing assembly.

With reference to FIG. 1, a block diagram of an antenna apparatus 100 is illustrated and includes a beam collimating system 104 and a beam control system 108. The beam collimating system 104 includes at least one compound curve antenna structure (CCAS) 130, which can be two-dimensional and/or three-dimensional. In the preferred embodiment, the curve is parabolic and the discussion herein for the compound curve antenna structure relates to a compound parabolic antenna structure. However, it should be appreciated that other compound curves may be incorporated including hyperbolic, elliptical and other reflectors that are curved in more than one dimension.

The beam control system 108 has a number of components or subsystems that include at least a feed array 112, a control/processing apparatus 116 and a memory storage 120. The feed array 112 has a number of feed or energizable elements that can be arranged in rows and columns. Depending upon the particular feed elements that are energized at any instance in time, an antenna beam can be produced having a certain direction or angle. Different feed elements in the rows and columns can be activated or energized at different times to produce an antenna beam that scans or moves through a number of angles constituting a scan range of angles. Changing the feed elements that are energized in a particular column can result in achieving a desired azimuth direction of the antenna beam. Changing the feed elements in a row of feed elements can change a desired elevation direction of the antenna beam. The antenna beam can be a transmit beam or a return beam. The transmit beam is generated and outputs or emanates from the antenna apparatus 100, while the return beam is received by the antenna apparatus 100. The return beam can be based on the transmit beam, another beam transmitted from a different system or not based on any particular beam that was previously transmitted.

With respect to controlling activation/energization of predetermined or desired feed elements of the feed array 112, the control/processing apparatus 116 is utilized, which typically includes one or more processors. As will be discussed in more detail later, the control/processing apparatus 116 communicates with memory storage 120 for obtaining predetermined data or other information that is used in determining or otherwise controlling the identities of the feed elements that are to be activated. Although not specifically depicted, the beam control system 38 can include other components such as at least a number of transmit/receive (T/R) modules, with the number thereof typically corresponding to the number of feed elements of the feed array 112. Phase adjusting circuitry is also utilized and such circuitry is primarily involved with controlling or causing desired positioning of the antenna beam in the azimuth direction when the CCAS 130 is two-dimensional. Under control of the control/processing apparatus 116, and applied signals received by the phase adjusting circuitry, a phase control signal is output related to which feed elements of the feed array 112 are activated. The phase control signal from the phase adjusting circuitry can be applied to the transmit/receive modules. The outputs from these modules typically include properly conditioned signals, such as with sufficient amplification, for subsequently energizing selected feed elements of the feed array 112. In that regard, the amplitude of this applied signal for a particular feed element relates to the density or quantity of radiation output (transmitted) or input (received) by that particular feed element. The amplitude can range from zero (or practically zero) to a desired maximum magnitude or value.

The CCAS 130 is based on a compound parabolic concentrator, which is intended to provide the theoretical best concentration ratio. The compound parabolic concentrator can be realized in two dimensions as a cylinder yielding substantially close to the best concentration for one plane in space ($1/\sin\theta$) or it can be realized in three-dimensions as a body of revolution yielding substantially close to the best concentration for a three-dimensional field of view ($1/\sin^2\theta$), where $\theta$ is the maximum scan angle relative to broadside. In one embodiment, a CCAS is based on or corresponds to a nonimaging concentrator, as described in U.S. Pat. No. 5,971,551 issued Oct. 26, 1999 to Winston et al. "Nonimaging Optical Concentrators and Illuminators."

A schematic representation of a two-dimensional CCAS 140 is shown in FIG. 2. The CCAS 140 includes a first or top curved (e.g., parabolic) reflector section 144 and a bottom or second curved (e.g., parabolic) reflector section 148. Each of the two parabolic reflector sections 144, 148 has an aperture that defines a particular size aperture for the CCAS 140. A feed array 152 is preferably disposed between the base ends of the two parabolic reflector sections 144, 148, with the base ends thereof being the opposite ends from the aperture ends for the two reflector sections 144, 148. A reflector axis (RA) is definable as extending through the center of the CCAS 140 aperture and passing through the center of the feed array 152, while being normal to the aperture plane.

Figure 4:
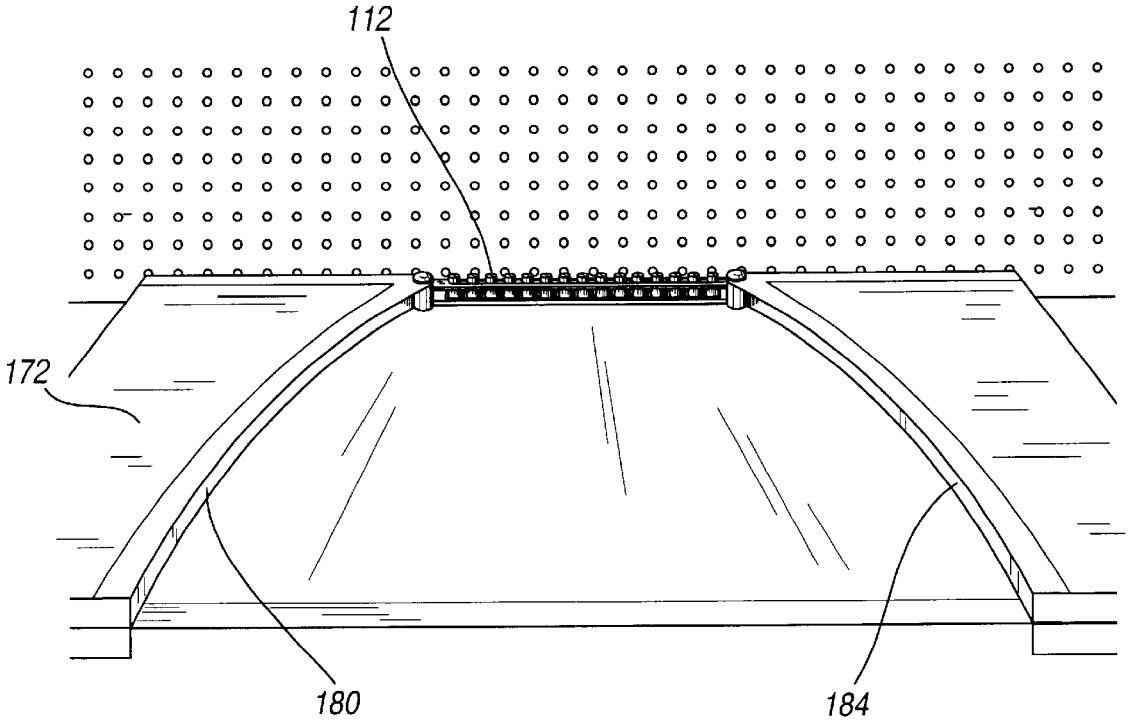
FIG. 4 illustrates the two-dimensional CCAS of FIG. 3 that exposes the two curved reflector sections and the feed array.
Figure 5:
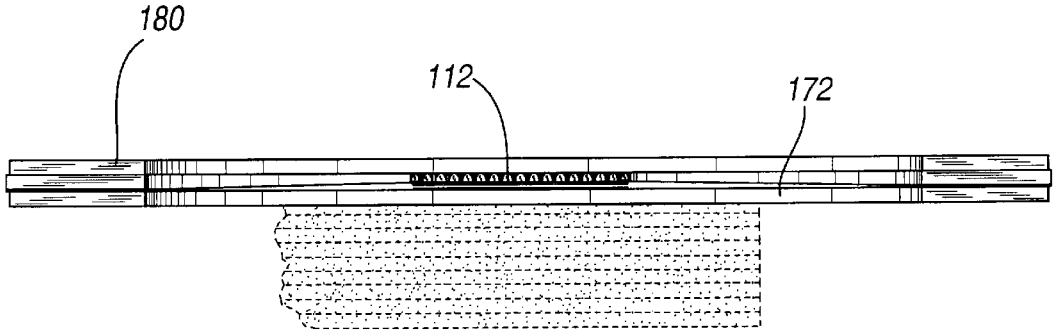
FIG. 5 illustrates in more detail the two-dimensional feed array of the two-dimensional CCAS illustrated in FIG. 3.

A constructed embodiment of a two-dimensional CCAS 160, together with the feed array 112, is illustrated in FIGS. 3–5. The CCAS 160 includes a housing assembly 164 with first and second sheets 168, 172. At the end of the housing assembly 164 adjacent to the feed array 112 is a connector assembly 176. As best seen in FIG. 3, the CCAS 160 includes a first curved (e.g., parabolic) reflector section 180 and a second curved (e.g., parabolic) reflector section 184. Preferably, the first and second parabolic reflector sections 180, 184 are first and second cylindrical reflectors. The feed array 112 can be located at the base ends 188, 192 of the two reflector sections 180, 184, respectively and is preferably disposed therebetween so that the two reflector sections 180, 184 are spaced from each other at their base ends 188, 192 using the feed array 112. Opposite from the base ends 188, 192 are the aperture ends 196, 200, respectively of the first and second reflector sections 180, 184. The aperture ends 196, 120 define the aperture of the CCAS 160. A reflector axis (RA) can be defined that extends through the center of the CCAS 160 aperture and passes through the center of the feed array 112 and is normal to the aperture plane. The two reflector sections 180, 184 are symmetrically located relative to this reflector axis. The two-dimensional CCAS 160 has two focii. With regard to the first reflector section 180, a first focii is located at the base end 192 of the second reflector section 184. For the second focii associated with the second reflector section 184, it is located at the base end 188 of the first reflector section 180. At the maximum scan angle associated with a particular CCAS 160, the EM radiation or fields associated with the beam at this angle are concentrated to essentially a focus point. In one embodiment, with continued reference to FIGS. 3–5, the parabolic cylindrical reflectors 180, 184 are positioned between copper plates (sheets) 168, 172. The copper plates 168, 172 are spaced about 0.5 wavelength apart at 10 GHz. The length of the feed array 112 is 0.28 meter with a 0.58 average wavelength feed element spacing. In one embodiment, the feed elements are spaced in the range of between about one-half $\lambda$ and about one $\lambda$, while being operated using modulo $2\pi$ phase shifters. Additionally, in one embodiment the electrical size of the antenna, particularly related to the size of the radiating aperture, is in the range of 10–500 wavelengths.

Figure 6:
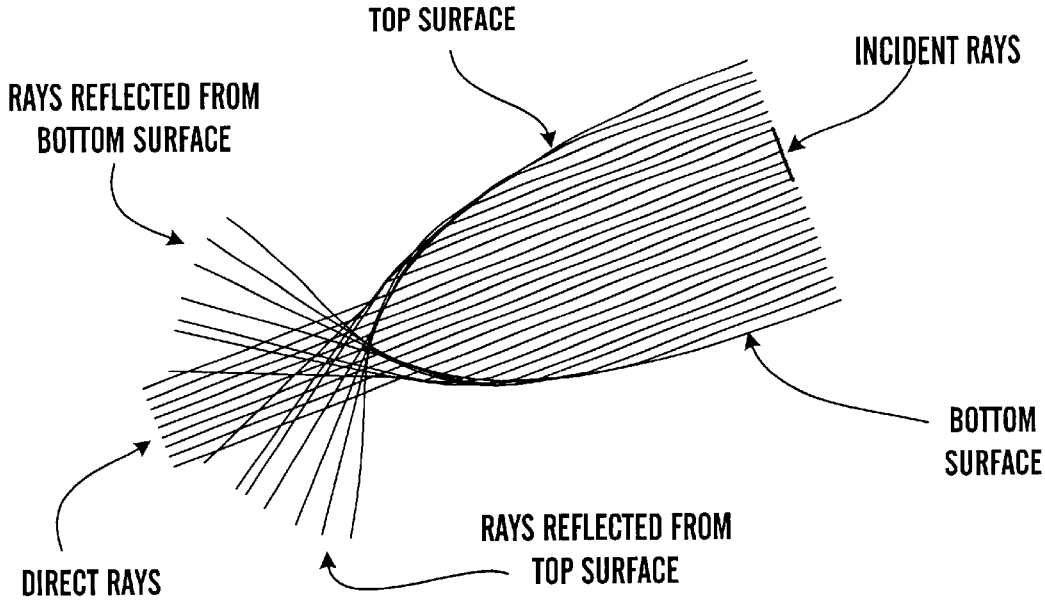
FIG. 6 represents contributions of EM radiation in conjunction with a two-dimensional CCAS.

With regard to providing or controlling an antenna beam, such as a transmit beam, using the CCAS 160, it is necessary to determine the identities of the particular feed elements of the feed array 112 that must be energized to produce the beam at a selected one angle of a range of scan angles associated with the CCAS 160. To determine the feed elements to be energized at the selected scan angle, an antenna apparatus, either the same or its equivalent (or substantial equivalent) as the antenna apparatus 100, is simulated or otherwise provided and a reference beam, which can be simulated by computer modeling including proper program code, is generated that acts like a return beam at the selected angle. The reference beam can be defined as comprised of a number of rf (radio frequency) signals or electromagnetic (EM) radiation or field(s). The reflections, contacts or paths of the EM fields are traced to obtain their contributions to the reference beam. EM radiation that enters the aperture of the CCAS 160 strikes the feed array 112 directly, or the EM radiation reflects from either the first parabolic reflector section 180 or the second parabolic reflector section 184 and then strikes the feed array 112 at an angle given by the law of reflection. Reference is made to FIG. 6 to illustrate the three kinds of contribution of EM radiation rays striking the feed array 112 for an incidence angle of 0° relative to a reference coordinate system. As can be understood, several EM fields may intersect the feed array 112 at the same feed element. Path length differentials imply phase differentials at the common location which cause field interference.

Figure 7:
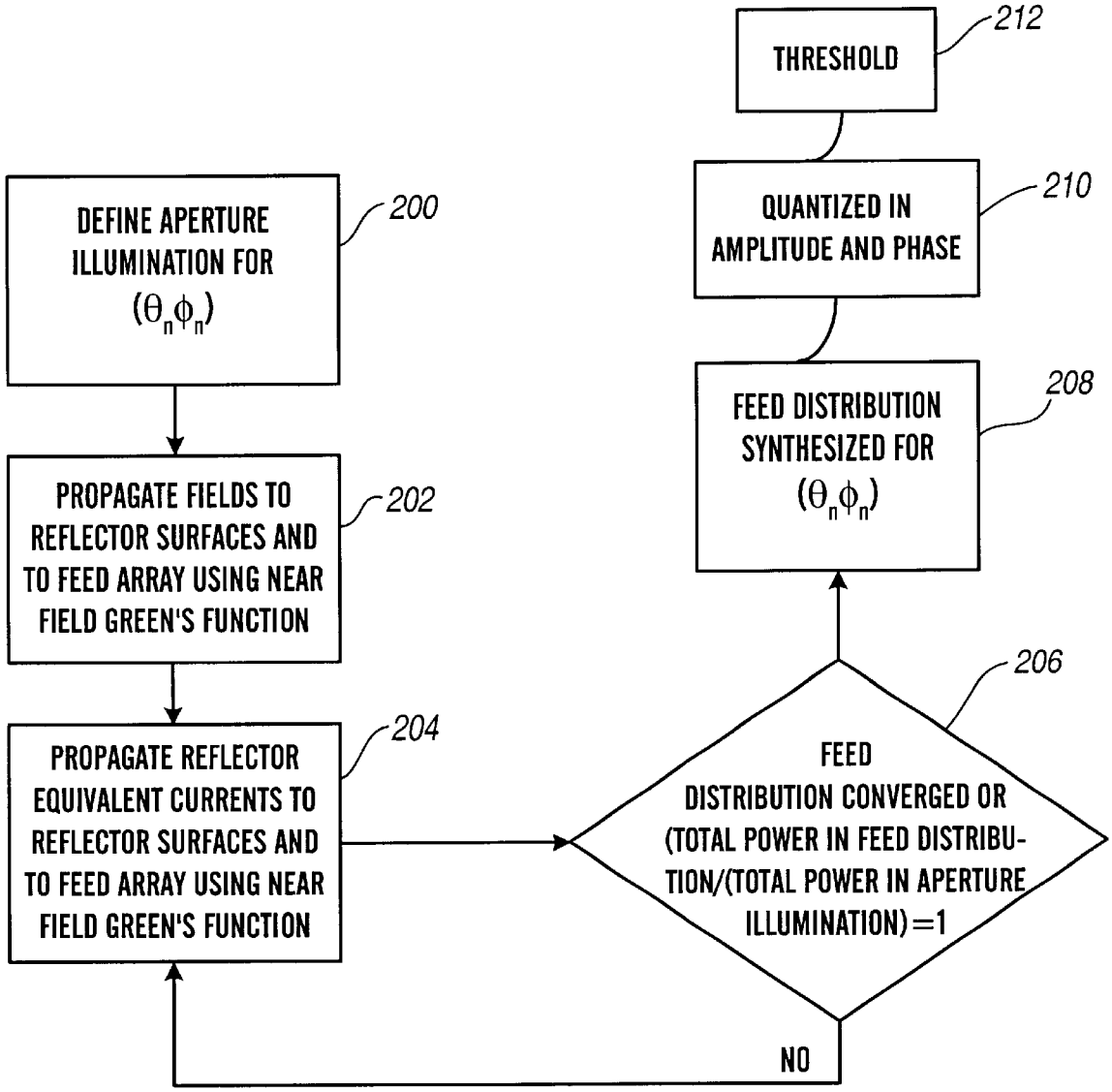
FIG. 7 is a flow diagram of major steps or stages associated with obtaining data that is stored related to energizing feed elements for different scan angles.

Referring next to FIG. 7, an analysis is discussed related to obtaining data to be stored based on one or more reference (simulated) beams for one or more scan angles. The analysis is conducted using simulation techniques including software that enables the providing or simulating of a reference beam at each desired scan angle. Further information related to such tools, modeling or simulation can be found in the publication identified as "Antenna Engineering Using Physical Optics: Practical CAD Techniques and Software," Artech House, Norwood, Mass. (1996).

In accordance with block 200, for a particular scan angle, the aperture illumination associated with that reference beam is defined and, for that particular scan angle, each of the feed elements will have an associated amplitude ($\theta_n$) and a phase ($\phi_n$) associated therewith. The amplitude relates to the density of the EM radiation associated with a particular feed point or element. The phase relates to the timing of energization for that particular feed point or element for the selected or desired scan angle. As can be understood, for each scan angle, each of the feed elements of the feed array will have an associated amplitude and phase that is to be determined by such analysis. In conjunction with defining the aperture illumination, the geometry of the CCAS including whether it is two-dimensional or three dimensional must also be defined and relied on by the program code in conducting the analysis.

At block 202, for the particular scan angle, reference or simulated EM fields are propagated to the reflector surfaces and feed array for the analyzed CCAS design or geometry using the Near Field Green's Function. This is a well-established way or technique related to making observations related to the simulated fields. In essence, EM fields are allowed to travel a distance according to the defined illumination, with the EM fields being tracked during their travel at different points of observation, such as at the feed array or reflector surface.

Subsequently, at block 204, reflector equivalent currents are generated. These equivalent currents are generated using a known EM tool for modeling and are utilized in connection with the simulated path tracking involving the particular CCAS design. Such reflector equivalent currents are observed in conjunction with their travel from or between reflector surfaces, as well as to the feed array. Such propagated reflector equivalent currents are observed also using the Near Field Green's Function.

At block 206, a determination is made related to whether the feed distribution has converged. If not, this means that further propagations to reflector surfaces and/or to the feed array are still occurring for the particular CCAS at the presently analyzed scan angle. In one embodiment, the feed distribution is found to have converged when the total power in the feed distribution is substantially equal to the total power in the aperture illumination. In making this determination, and generally for two-dimensional CCASs, the feed distribution converges after no more than two reflector equivalent currents were allowed to propagate (one additional "bounce" after the EM field first contacts or strikes a reflector surface). With three-dimensional CCASs, the total power in the feed distribution substantially corresponds to the total power in the aperture illumination after no greater than five "bounces" and after at least one such bounce. Hence, for at least three-dimensional simulated CCASs, additional reflector equivalent currents are propagated and observations taken until the check or determination at block 206 indicates that the feed distribution has converged. In such a case, at block 208, the feed distribution is indicated as being synthesized for the selected scan angle whereby amplitudes and phases associated with the feed elements of the feed array for this angle have been determined. Then, at block 210, this information can be quantized in the form of digital bits that can be stored in memory so that, when transmitting or receiving a beam at the selected scan angle, proper amplitudes and phases can be applied to each of the feed elements of the feed array including whether to activate a particular feed element at all. In that regard, at block 212, a determination is made as to whether one or more feed elements makes a sufficient contribution to warrant activating that feed element. For example, if a particular feed element for a selected scan angle does not satisfy a threshold level, then it is not activated and assumed to make no contribution to the resulting beam being generated. Regarding the magnitude of the phase, a 3–5 bit phase shifter is found to be sufficient, where the 3-bit phase shifter provides increments of 45°.

In connection with the quantization Of the feed distribution and as applied to the feed elements, in one embodiment, a magnitude or value of maximum power is defined and each of the contributing feed elements is assigned some portion or percentage of the maximum power whereby a weighting is provided for each of the feed elements for the selected scan angle, which relates to the amplitude ($\theta$). In one embodiment, the phase values or magnitudes that are determined have linear characteristics relative to each other.

Some, but not all, of the analysis and utilization of tools associated with FIG. 7 were used with the antenna apparatus described in U.S. Pat. No. 6,043,779 to Lalezari et al. issued Mar. 29, 2000 and entitled "Antenna Apparatus with Feed Elements Used to Form Multiple Beams." In that antenna apparatus, a parabolic reflector is included, which is not a CCAS. Thus, unlike the CCAS, steps are not conducted in determining feed distribution convergence, particularly in the context of propagating reflector equivalent currents after fields are propagated to the reflector surfaces and to the feed array. That is, there is no additional analysis concerning additional "bounces" as there is when a CCAS is used due to the CCAS geometry.

Figure 8:
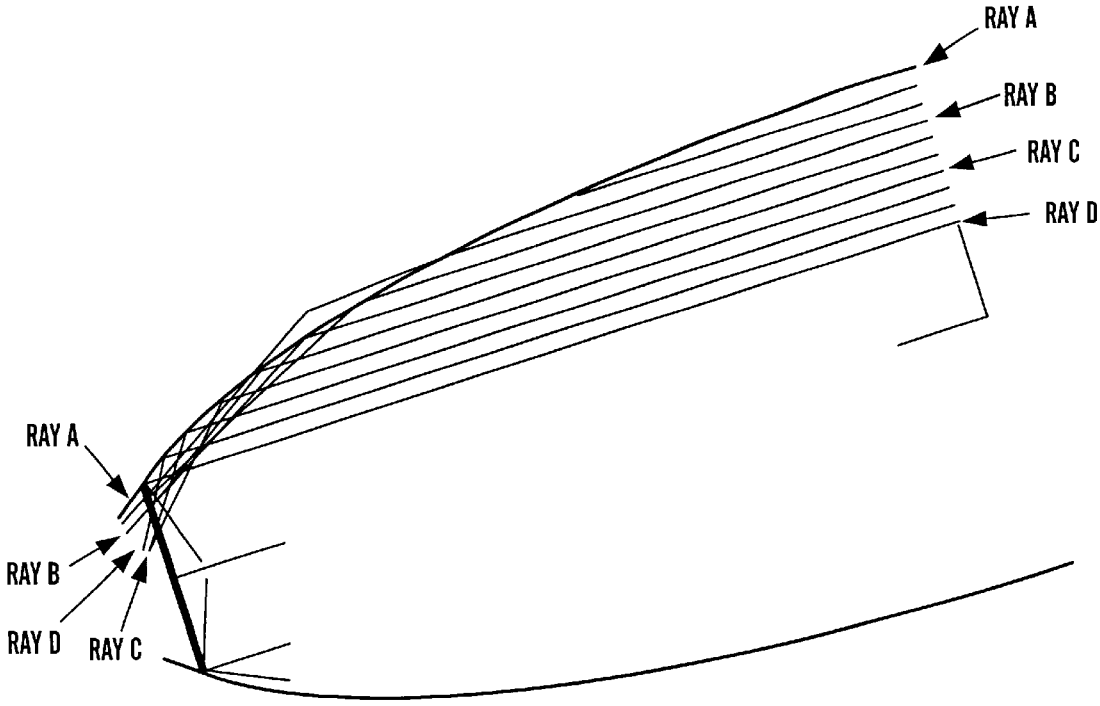
FIG. 8 is a diagrammatic representation that illustrates the direct field path length increasing linearly across the feed array.

With reference to FIG. 8, the direct field path length increases linearly across the feed array 112 proportional to d sin θ, as the scan angle is increased. However, the EM fields reflecting from one or two of the reflector sections 180, 184 have a different path length. To determine their path lengths, they must be traced separately. As illustrated in FIG. 6, reflections increase in path length as they move down the particular reflector section 180, 184 from the aperture (see EM radiation A, B and C). The EM radiation eventually reaches a point along the surface of the particular reflector section 180, 184 where the reflected EM radiation begins to retrace back across the feed array 112 (see ray D).

Figure 9A:
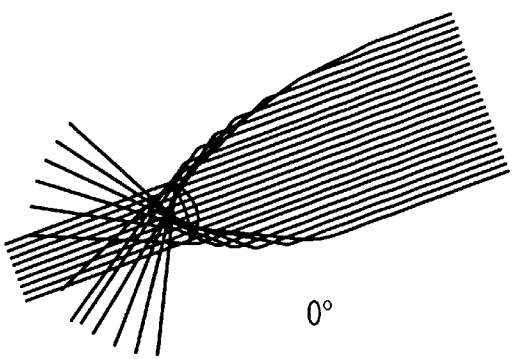
FIGS. 9A–9E illustrate diagrammatically direct field paths at different scan angles, namely, 0°, 5.5°, 11°, 16.5° and 22°.
Figure 9B:
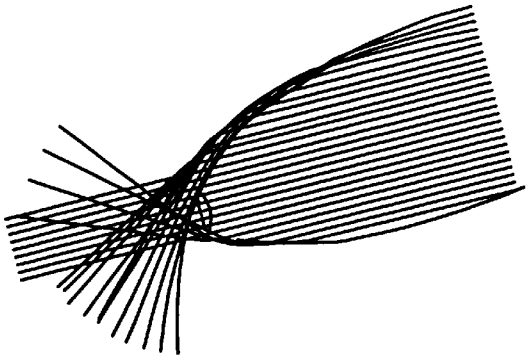
Figure 9C:
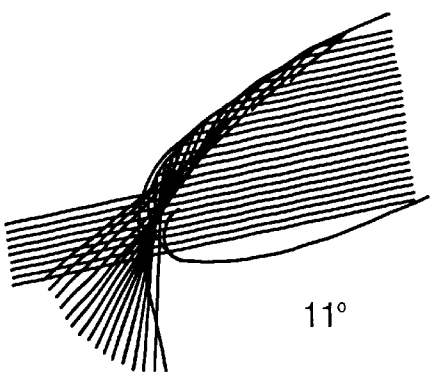
Figure 9D:
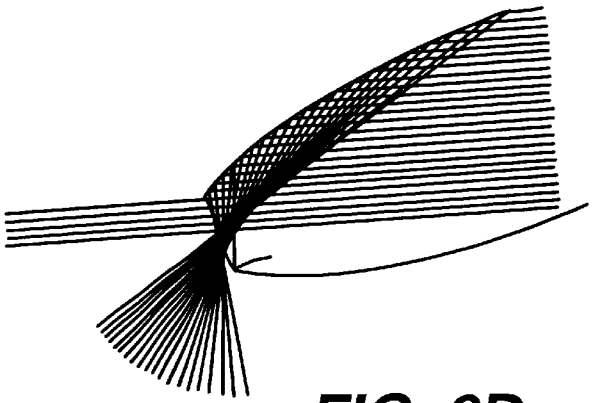
Figure 9E:
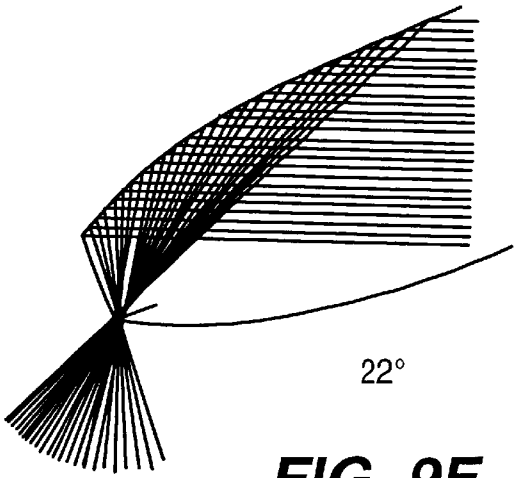

With reference to FIGS. 9A–9E, diagrammatic representations are provided of EM radiation paths for a CCAS 160 having a designed or predetermined scan range of −22°−+22° so that the maximum scan angle is 22°. For the maximum scan angle in one direction (+22°), it is seen that the maximum scan angle causes the EM radiation to become focused, as depicted in FIG. 9E. The feed length remains constant but the phasing and amplitude control associated with the feed array 112 becomes less complex because fewer feed elements are activated and all EM radiation has substantially the same length. When the scan angle approaches the maximum 22° scan angle for this example, the fields are focused at the intersection, or essentially the intersection, of the feed array 112 and the opposite reflector section 184, which is opposite the first reflector section 180.

Figure 10:
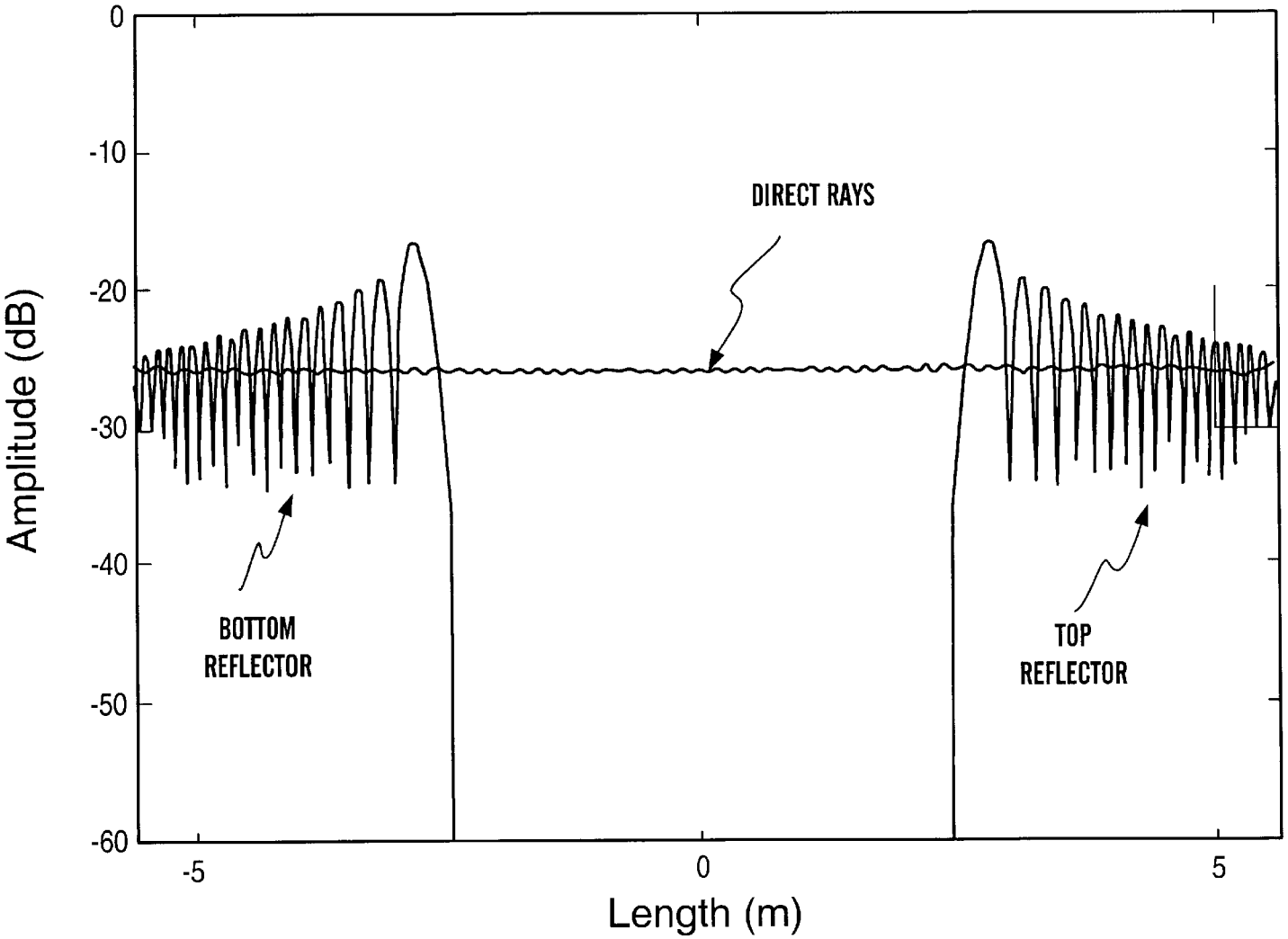
FIG. 10 is a diagram illustrating reflections along the length of a feed array.

Referring next to FIG. 10, EM fields incident on the feed array 112 from direct EM radiation, EM radiation reflected from a bottom reflector (e.g., second parabolic reflector section 184) and EM radiation reflected from a top reflector (e.g., first parabolic reflector section 180) are shown. Hence, the physical optic generated fields on the feed array 112 by the three contributions are represented in FIG. 10 and the total feed array field is determined by the superposition of each contribution. The direct fields span or contact the feed array 112 along at least portions of its length (depending on the incident scan angle). The top and bottom contributions span only portions of the feed array length depending upon the incident scan angle. The ripple apparent in the reflector contributions is due to the reflected EM radiation folding back.

Figure 11:
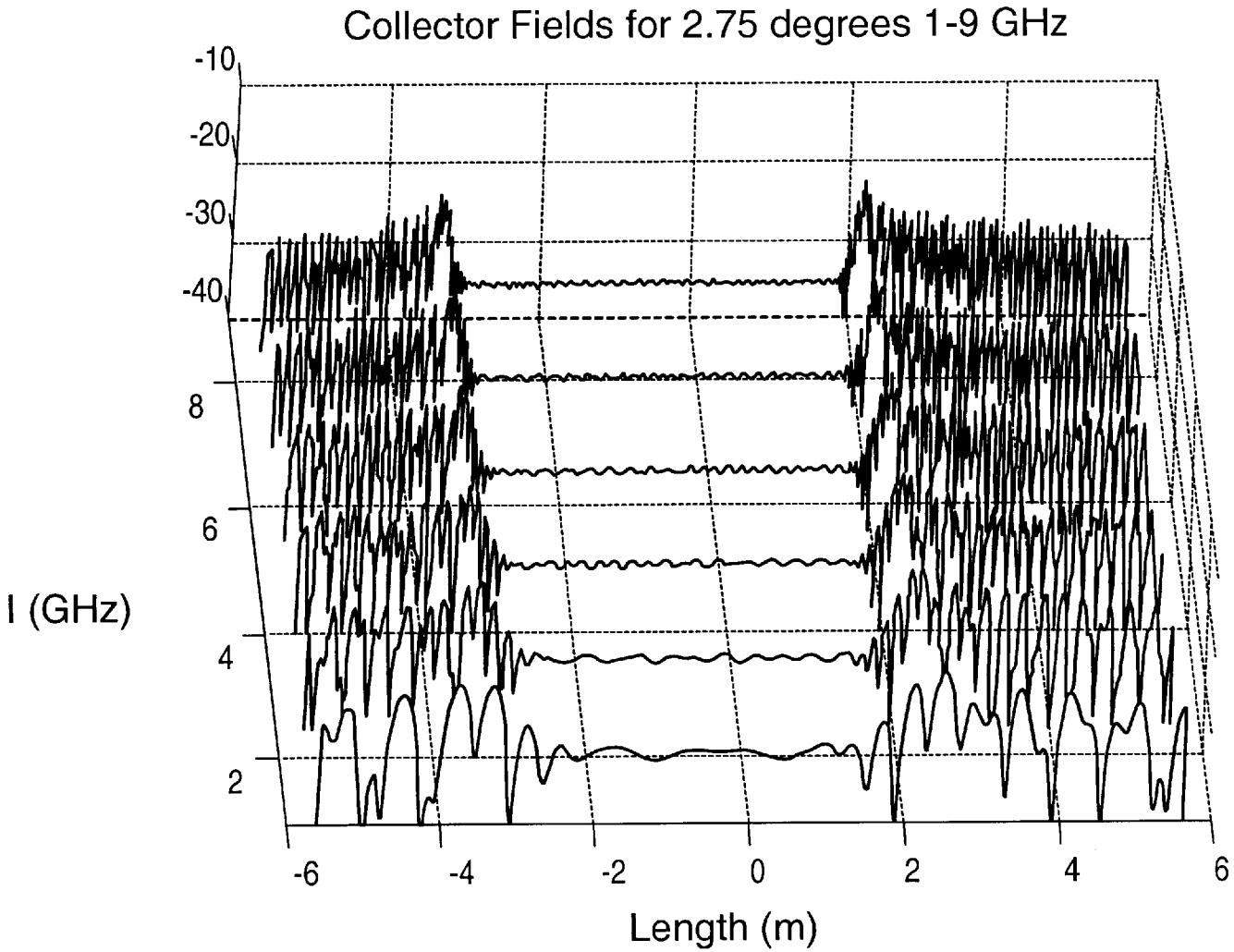
FIG. 11 diagrammatically illustrates a superposition of top, bottom and direct uniform fields on the feed array for a scan angle of 2.75° in a 9 GHz frequency range.

FIG. 11 depicts the total field for uniform illumination at the CCAS 160 for a 2.75° incidence angle over a 1 to 9 GHz range. The fields are shifted slightly along the feed array 112 with increased scan angle compared to the zero degree incidence distribution, but only change in periodicity with frequency. The minimum periodicity of the ripple is 1.2 $\lambda_0$ and is a function of the CCAS length. The distribution is normalized to provide unity power on transmit.

Figure 12:
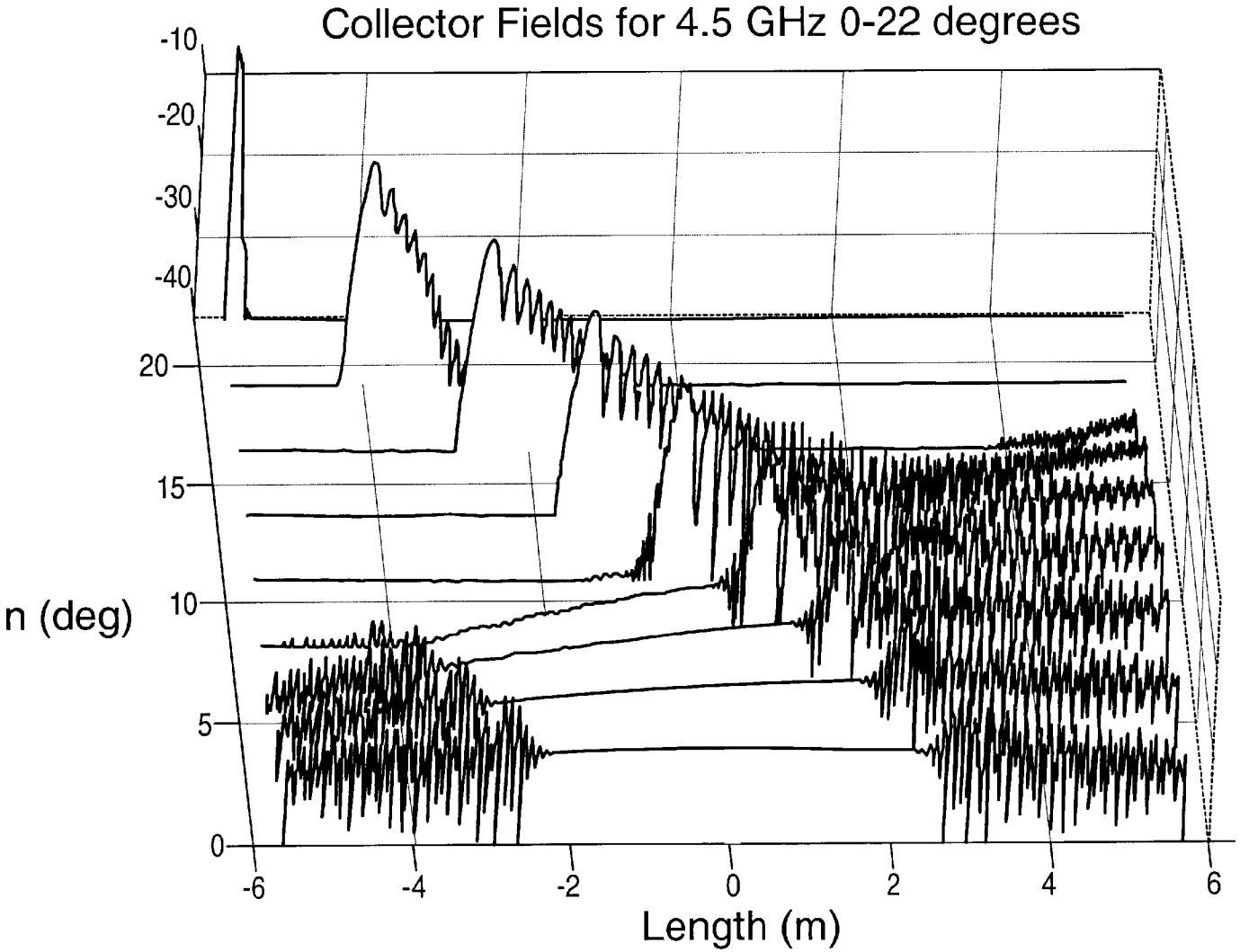
FIG. 12 illustrates collection of fields on a feed array in a 0–22° range of scan.
Figure 13:
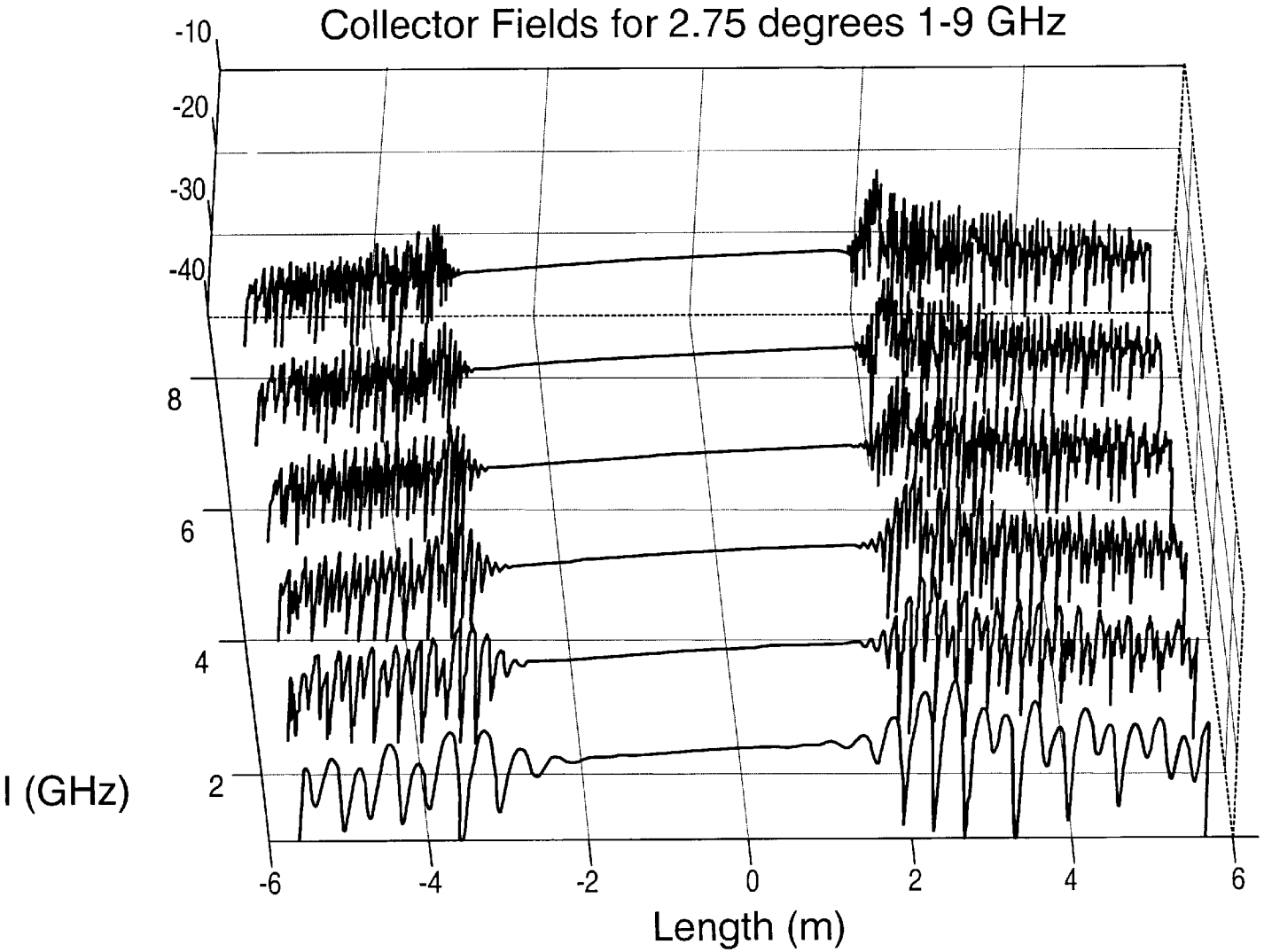
FIG. 13 is a diagram similar to FIG. 11 but with a Taylor taper application.
Figure 14:
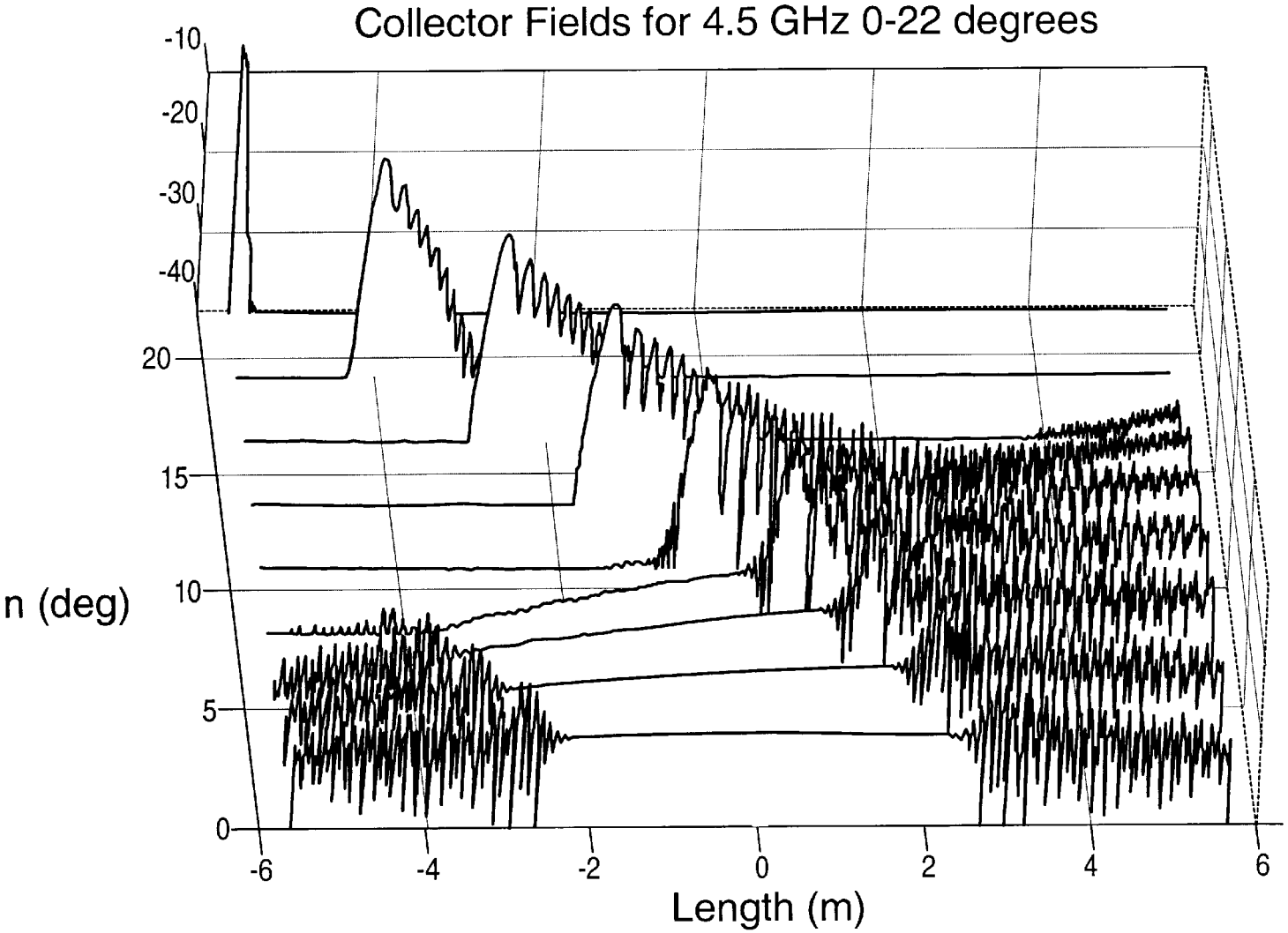
FIG. 14 is a diagram similar to FIG. 12 but with a Taylor taper application.

The EM fields that are collected by the feed array 112 are characterized over the full scan range at 4.5 GHz in FIG. 12. It can be seen from this that the entire length of the feed array 112 must be used for relatively small scan angles in the range of scan angles, whereas only a portion of the length of the feed array 112 is utilized for relatively large scan angles (e.g., 22°). Hence, fewer feed elements of the feed array 112 are necessary to control the CCAS 160 EM radiation at these relatively large scan angles because the EM field distribution is much more focused.

With reference to FIGS. 11 and 12, it is noted that a Taylor taper can be applied. The aperture associated with the field array 112 is tapered in order to improve the far field sidelobe level. FIGS. 11 and 12 illustrate fields or rays collected by the feed array 112 with the Taylor taper applied, with FIG. 11 showing a 2.75° scan angle for 1–9 GHz and FIG. 12 showing all scan conditions at 4.5 GHz. The Taylor taper smooths high frequency ripple, causes steeper roll-off and produces distinct peaks and nulls. These characteristics reduce the complexity of the feed fields and help to lower the far field sidelobe levels. The CCAS 160 far fields for a 2.75° scan angle with a Taylor taper applied to the CCAS 160 aperture distribution indicates a significant improvement over the far field sidelobes using a uniform aperture distribution.

Figure 17:
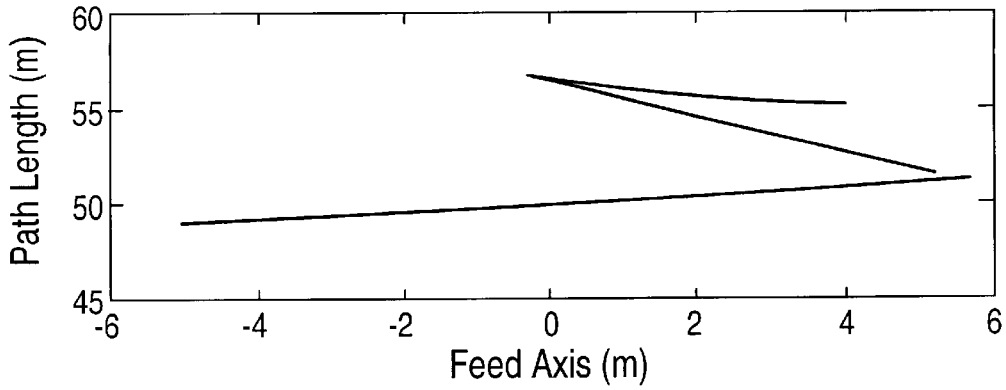
FIG. 17 is a diagram illustrating path length as a function of the length of the feed array.
Figure 18:
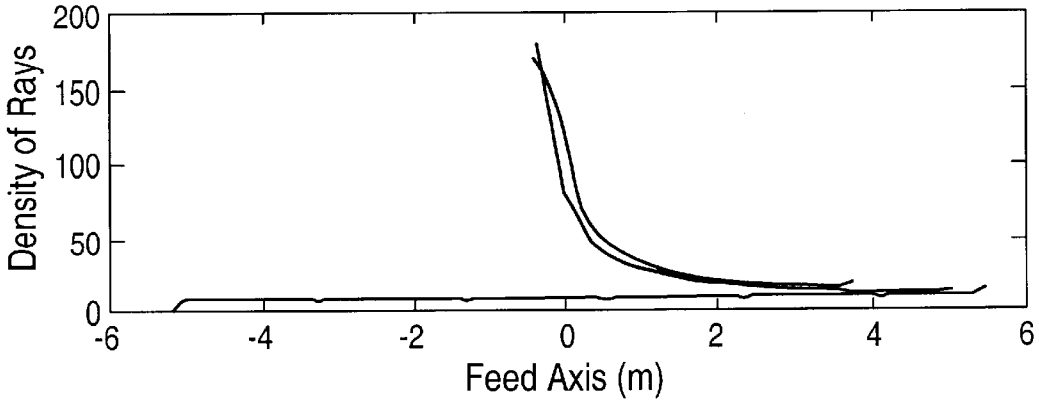
FIG. 18 is a diagram that illustrates the density of EM fields that are collected as a function along the length of the feed array.

With respect to implementing a particular way of controlling the activation/energization of the feed elements of the feed array 112, reference is first made to FIGS. 15–18. According to a first way for implementing such control that relies on the predetermined information stored in the memory storage 120, a known true time delay (TTD) implementation is utilized that is intended to simplify the complicated feed distributions across the feed array 112 and enable feeding of the CCAS 160 for wide bandwidths. In that regard, as illustrated in FIG. 15, an antenna beam (a reference beam, a transmit beam, a receive beam or a return beam) has EM radiation that does not follow a single linear path as the EM radiation moves from one end to the other end of the feed array 112. Instead, the path lengths of the reflected EM radiation first increase linearly, then decrease linearly in a direction towards the middle of the feed array 112. Further indicative of a distribution and path length is provided in FIG. 16 in which the ray path distribution for a 11° incidence angle is depicted. There are essentially three phasors that determine the total phase distribution at a given point on the feed array 112. Direct EM radiation when incident upon the feed array 112 with 0° scan angle has equal path length across the feed array 112. For all other angles, the direct path length increases linearly, as further illustrated in FIG. 17. EM radiation from a parabolic reflector section has path lengths increasing linearly to a position determined by the geometry of the CCAS 160 and incidence scan angle (e.g., 11° for FIG. 17). When the maximum position is reached, the EM fields then retrace back along the length of the feed array 112 and decrease their path length linearly. Three phasors representing each incident EM field at a single point can be used as a model to describe the total field distribution associated with the feed array 112. Amplitude weight is determined by the density of rays vs. feed position (FIG. 18) and phase control is determined by the differential path length (FIG. 17). By independently controlling the amplitude in true time delay for each signal path, a substantially wide band beam forming arrangement for the CCAS 160 can be realized. In comparison with phased arrays having the same directivity, the total true time delay associated with the CCAS 160 is less.

In another embodiment for implementing the appropriate controls that are related to producing an antenna beam, a fixed amplitude and phase control is included that is optimized for a center frequency and allows the operating frequency to sweep across the band of desired frequencies.

Figure 19:
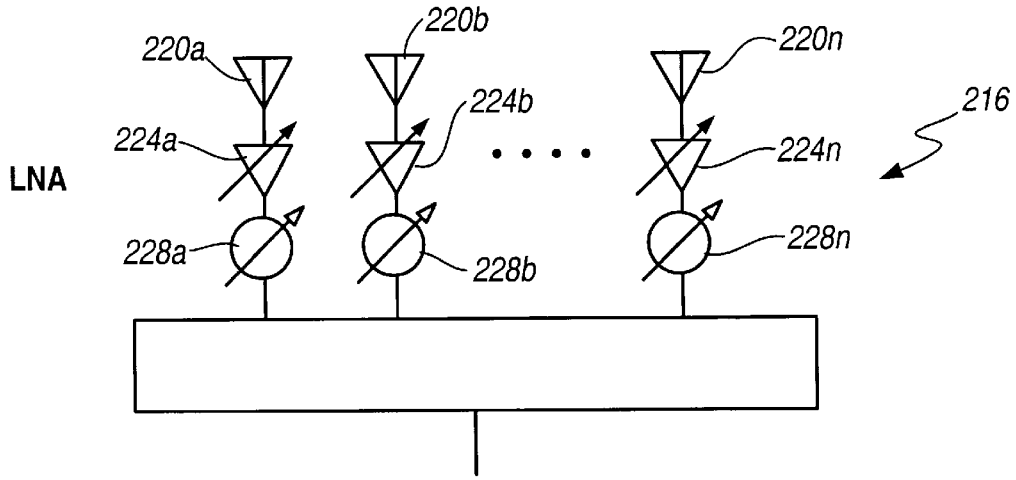
FIG. 19 illustrates phase adjusting circuit used in implementing antenna beam control identified as fixed amplitude and phase control.

This implementation uses fewer components than the TTD implementation, as illustrated by the phase adjusting circuit 216 in block diagram form in FIG. 19. This phase adjusting circuit 216 communicates with the feed elements 220*a* . . . 220*n* of the feed array 112. The phase adjusting circuit 116 has a number of phase adjusting elements 228*a* . . . 228*n*. The phase adjusting elements 228 communicate with their respective feed elements 120 through the low noise amplifiers (LNA) 224. By this implementation, the bandwidth performance is essentially inversely proportional to the size of the CCAS 160. By way of example, a 32 meter (450 $\lambda_0$) aperture CCAS 160 has less than 1% bandwidth, which contrasts with a two meter (30 $\lambda_0$) aperture CCAS 160 having a bandwidth of 10%. Accordingly, a higher bandwidth is best achieved by a smaller CCAS 160. However, to achieve the desired gain, an array of such smaller CCAS 160 are utilized to populate the desired aperture area.

Figure 20:
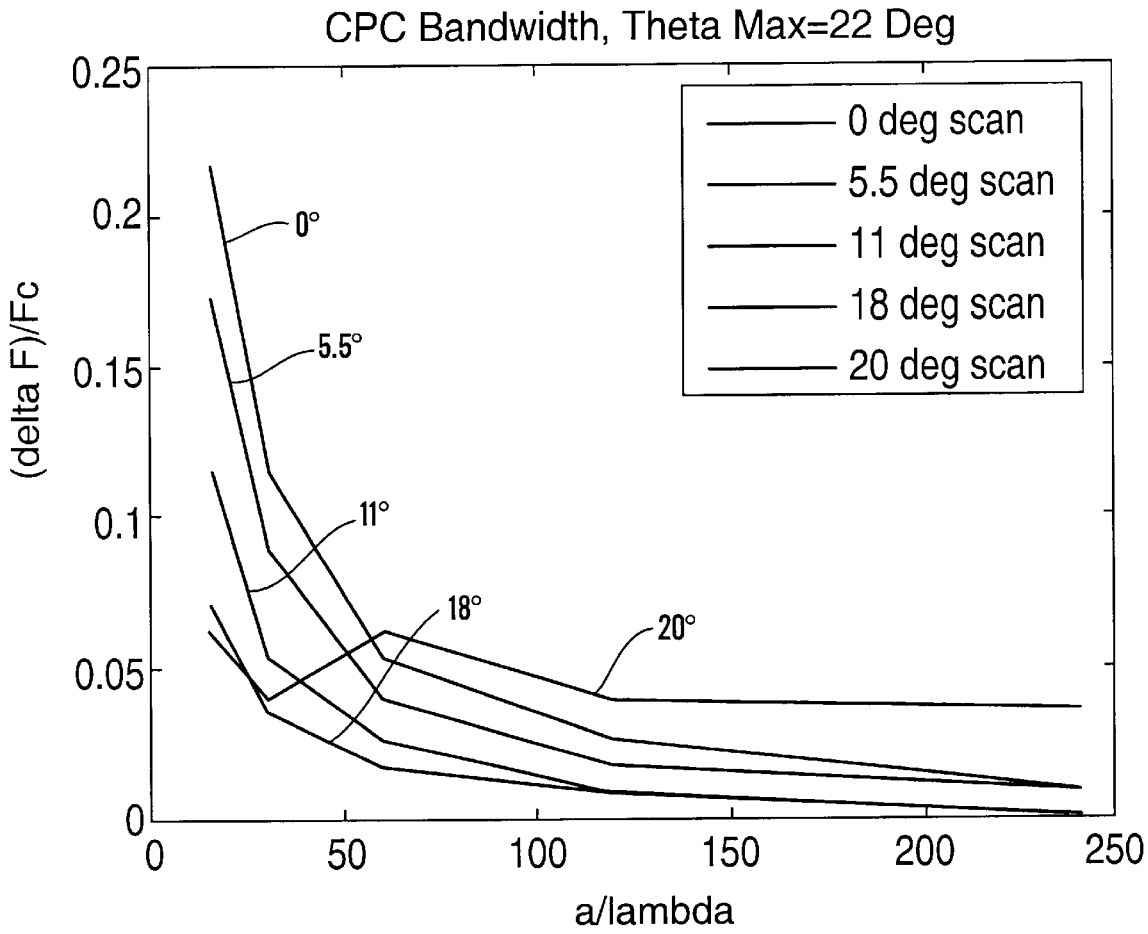
FIG. 20 is a diagram illustrating that bandwidth is inversely proportional to CCAS electrical size.

With respect to obtaining a desired bandwidth, it is determined that bandwidth is inversely proportional to the CCAS 160 size over all scan angles. This is illustrated in FIG. 20. Along the x-or horizontal axis. the half aperture size (a) is normalized in terms of wavelength and the y-or vertical axis is presented in terms of a change in frequency ($\delta F$) over the center frequency ($F_c$). It is noted that the 20° case appears different from the other angles since the feed excitation collapses to a single point and the instantaneous bandwidth becomes infinite as the angle approaches the maximum design angle of 22° associated with this particular CCAS 160.

Figure 21:
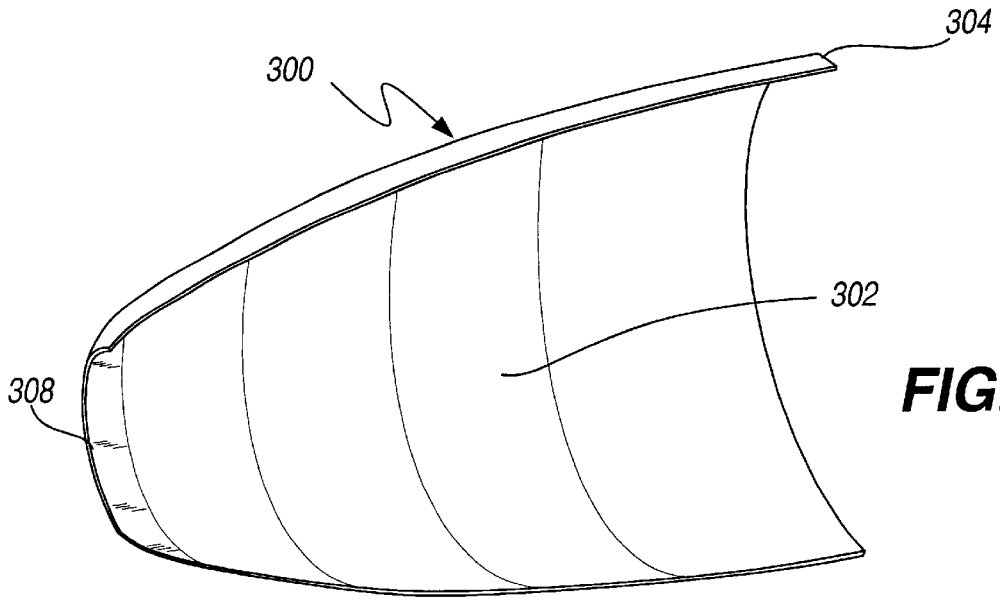
FIG. 21 illustrates a section of a three-dimensional CCAS.

With reference to FIG. 21, a three-dimensional CCAS 300 is next described. Like the two-dimensional configuration, a determination is made regarding reflections for a number of different scan angles between the maximum scan angles for the particular CCAS 300 (e.g., ±25°). Such information is used subsequently in controlling the feed elements of the feed array that is used with the three-dimensional CCAS 300. In connection with obtaining the information, the procedures and analyses associated with FIG. 7 are conducted for the three-dimensional configuration. This same kind of information is obtained for a number of scan angles. The three-dimensional CCAS 300 is a body of revolution based on the two-dimensional configuration. FIG. 21 shows a cross-section of the three-dimensional CCAS 300 designed for a ±25° field of view with a 20 $\lambda_0$ diameter aperture at X-band. The three-dimensional CCAS 300 includes a body 302, and an aperture end 304 and a base end 308. Like the two-dimensional configurations, the aperture end 304 defines an aperture through which transmit and receive beams are passed. The base end 308 is at the opposite end of the body 302 and typically has a feed array adjacent to it.

Figure 22:
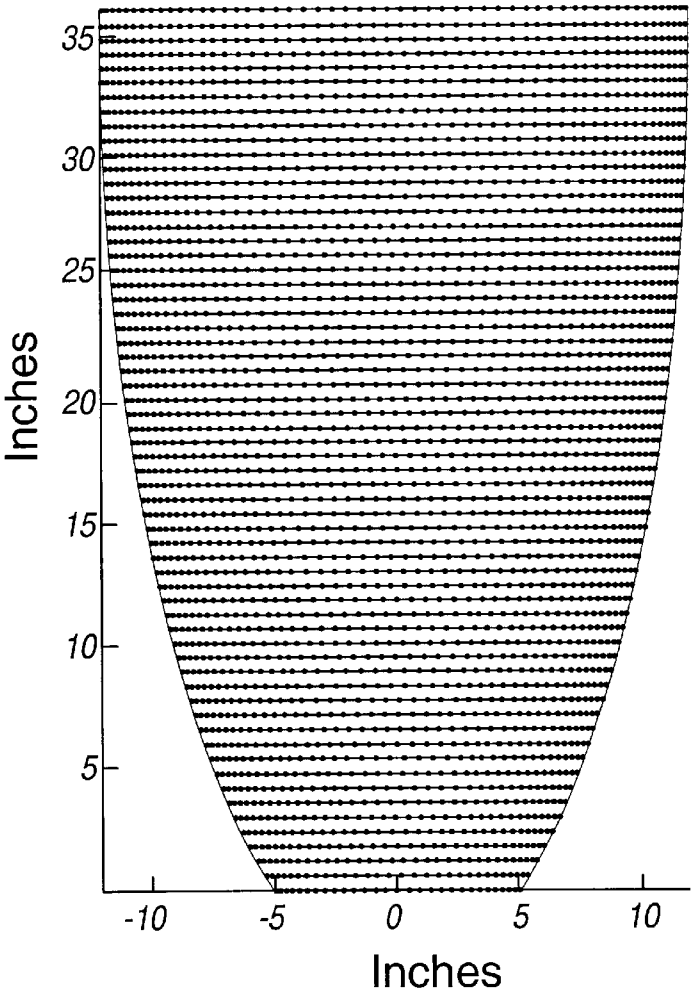
FIG. 22 diagrammatically represents a physical optics mesh for the three-dimensional configuration.
Figure 23:
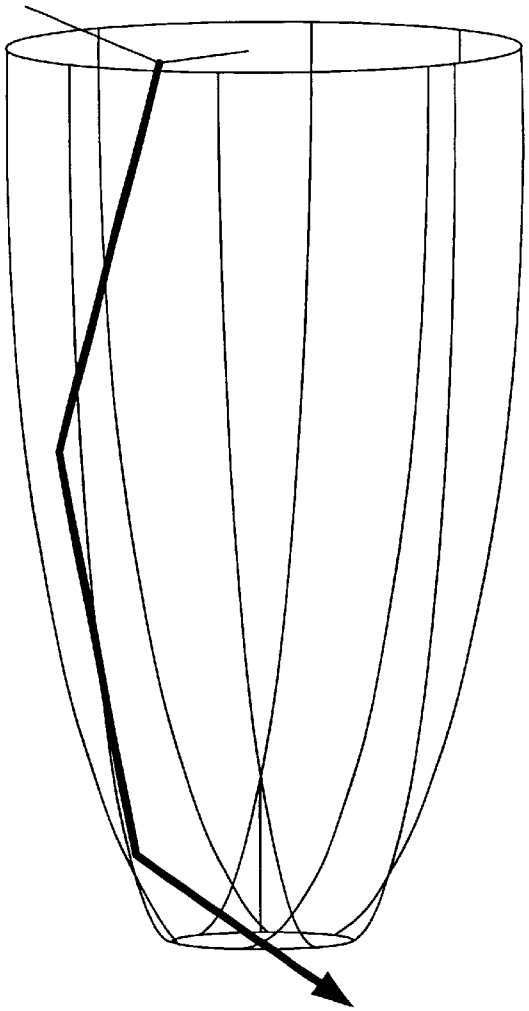
FIG. 23 diagrammatically illustrates an EM radiation multi-bounce path for the three-dimensional CCAS.

Referring to FIG. 22, a physical optics mesh used for the three-dimensional CCAS analysis is illustrated. Both the reflector surface and the detection plane are sampled at $\lambda_0/2$ at the highest analysis frequency in order to ensure convergence in order to analyze the CCAS 300 using a receive or reference beam. The CCAS 300 aperture is filled with a magnitude and phase distribution corresponding to the desired scan angle and amplitude taper. This distribution is propagated to the feed array that is also typically located at the base end of the CCAS 200. The direct and reflected radiation contributions are sampled and vector-summed at such a feed array. Accordingly, the derivation of the appropriate amplitude, phase, and polarization weightings associated with the light rays received at the feed array at the desired scan angle and desired sidelobe distribution can be made. The shape of the three-dimensional CCAS 300 surface allows for incident rays within the scan range to reflect from the CCAS interface multiple times before reaching the feed array. As seen in FIG. 23, a multi-bounce EM radiation path for one of the EM fields entering the aperture end 304 at a scan angle of 15° for the three-dimensional CCAS 300 of FIG. 21 is illustrated.

The multiple reflections experienced by an incoming beam or wave as it passes through the three-dimensional CCAS 300 do not preserve the polarization of the incident wave. The analyses that were conducted on this CCAS 300 used a linearly x-polarized aperture distribution. Fields sampled at the feed array in this same coordinate system included components in all three vector directions. The field component normal to the plane of the feed array was neglected, but the two tangential components were retained. The field distributions at the plane of the feed array for the CCAS 300 due to a linearly x-polarized uniform plane wave at 0° incidence for a relatively low frequency varied with scan angle.

Figure 24:
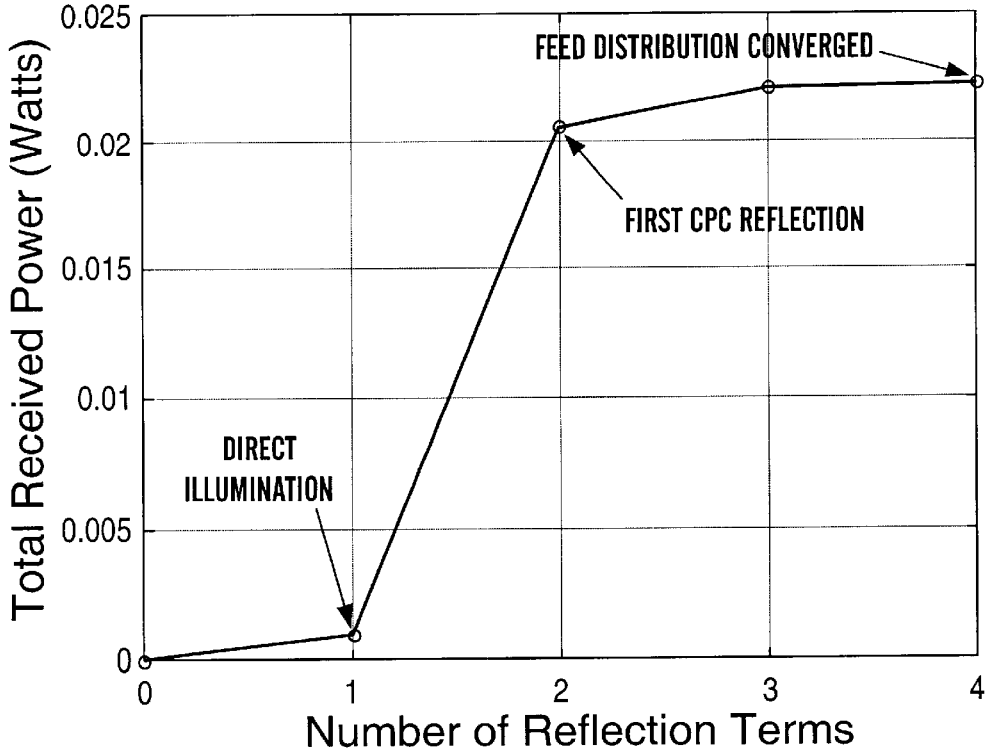
FIG. 24 is a diagram illustrating total receive power at the feed array as a function of the number of reflections.

The number of reflections included in the analysis of the three-dimensional CCAS 300 was determined by calculating the contribution of each successive reflection on the inner surface of the CCAS 300 to the total power collected at the feed array. The feed distribution was considered to be converged when the power delivered by the "final bounce" fell below 1% of the total power collected from all reflections. FIG. 24 illustrates a typical distribution of receive power verses the number of reflections included in the analysis. As can be seen, the majority of the receive power is contained in the first reflection from the inner surface of the CCAS 300.

Based on the analysis conducted With a desired and controlled receive beam to obtain the field distributions on the feed array, such distributions were conjugated to reverse the direction of propagation. These fields were propagated back through the CCAS 300 to the aperture end 304 using the same number of reflections used in the analysis conducted using the generated receive beam. Such fields were then propagated to the far field to identify principal plane antenna patterns. The aperture distribution for this analysis was uniform so that sidelobe levels of approximately −13 dB and beam widths of about 6° typically result.

The multiple reflections within the three-dimensional CCAS 300 produce multiple paths for incoming EM radiation to reach the same feed element location of the feed array. Such EM radiation interferes constructively or destructively depending on relative phases. Each EM radiation path has a different length and thus a different phase delay which is frequency dependent. The net feed distribution changes with frequency due to these multiple interfering EM fields. This interference mechanism limits the bandwidth of the CCAS 300 when using fixed amplitude and phase weighting for the feed array elements. Reducing the size of the CCAS 300 also reduces the difference in path length for different EM radiation paths. Because the relative path length differences are reduced, the difference in phase delay between fields does not vary as quickly with frequency and thus the instantaneous bandwidth is increased.

Figure 25:
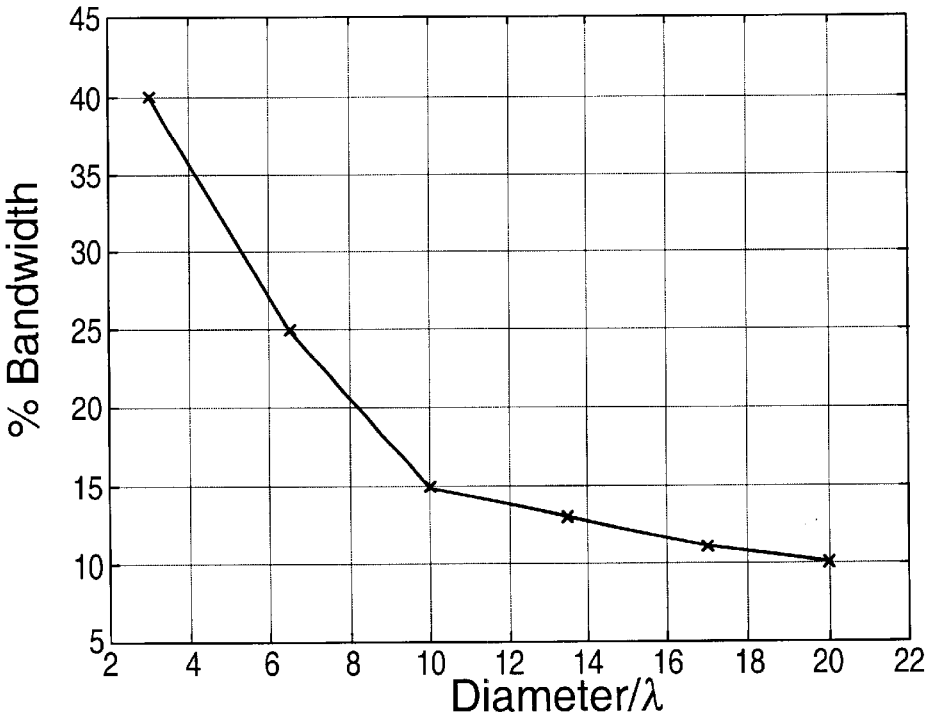
FIG. 25 is a diagram illustrating bandwidth of a three-dimensional CCAS as a function of the diameter of the radiating aperture in wavelengths.

An analysis was done to determine the maximum size for an aperture end 304 of the CCAS 300 in the context of a desired instantaneous bandwidth. A set of fixed feed weights was derived at a nominal center frequency of 1 GHz and then the same set of complex weights was used at several other frequencies to determine the degradation in collimated radiation performance with frequency. The 3 dB beam width and the first sidelobe level were monitored at each frequency to determine how much the far field pattern had degraded. A maximum sidelobe threshold of −11 dB (for a uniform aperture distribution) and a maximum beam width variation of ±5%, were used as the criteria for usable instantaneous bandwidth. FIG. 25 illustrates a summary of the percent bandwidth obtainable by a three-dimensional CCAS 300 with diameters between three and twenty wavelengths and a spacing or distance between the feed elements of the feed array being about 0.5 $\lambda_0$. As seen in FIG. 25, the physical dimensions are presented in terms of wavelengths that allow the results to be applied to scaled CCASs at other frequencies.

Figure 26:
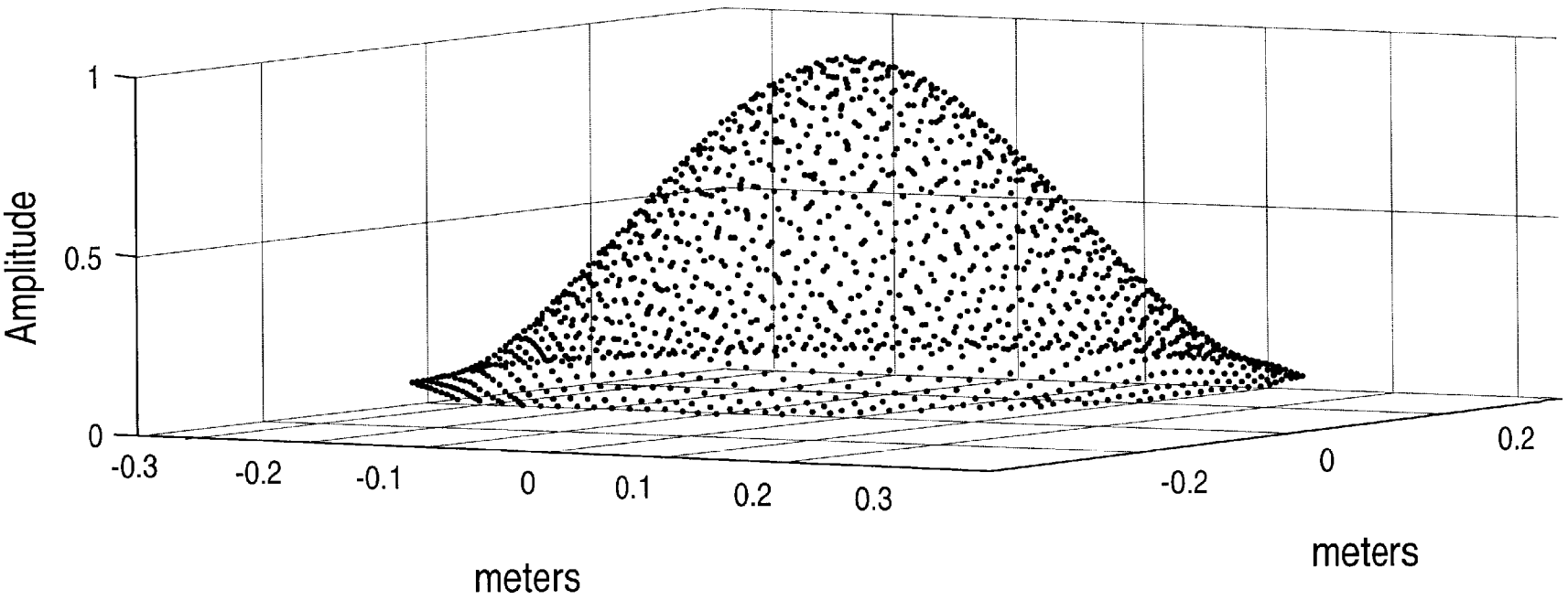
FIG. 26 is a diagram that illustrates the Taylor amplitude taper.

Instead of a uniform aperture associated with the three-dimensional CCAS, a Taylor taper field distribution for the incident wave or beam can be used. Such a taper is designed to produce sidelobes of −24 dB below the peak gain value. The analysis procedure utilized for the uniform distribution was repeated for the tapered aperture. The amplitude distribution used in this analysis is shown in FIG. 26. The tapered aperture CCAS has similar feed characteristics to the uniform aperture embodiment. Both X- and Y- polarized elements are needed and the amplitude and phase distributions vary with scan angle in a similar fashion.

With respect to far field performance, the tapered aperture distribution produces low sidelobes by avoiding a discontinuity in the aperture fields at the rim of the CCAS. Compared to the uniform aperture, the overall sidelobe levels decrease with typical first sidelobe levels of −25 dB compared to −13 dB for the uniform aperture. The low radiation levels outside the CCAS maximum angle for a particular field of view are maintained with the tapered aperture distribution. However, low sidelobes come at the expense of aperture efficiency and directivity. The tapered illumination of the CCAS reduces the effective radiating area and thus the directivity. On the other hand, scan loss is improved compared to the uniform aperture CCAS, with less than 0.2 dB of scan loss at 10 GHz and a worst case scan loss of 1.4 dB at 10.5 GHz.

Like the two-dimensional CCAS, the geometry of the three-dimensional CCAS comes substantially closer to achieving the theoretical maximum reduction in the size of the feed array for a given aperture size and maximum scan angle, in comparison with the prior art. The three-dimensional CCAS requires a dual-polarized feed to receive a single linear polarization. This requirement allows the CCAS to be used as a dual-polarization system without additional feed elements. Multiple reflections within the CCAS lead to interference phenomena at the plane of the feed array, which in turn limits the bandwidth of a CCAS using fixed feed array weights. Reducing the size of a single CCAS increases the available instantaneous bandwidth, but this limits the maximum gain of such a CCAS. An alternative that can be utilized for high gain systems, which require broadband operation, is to combine a number of such smaller CCASs into an array of such CCASs. Each CCAS pattern is relatively highly directive compared to conventional phased array elements, so sparse array techniques can be used while reducing performance degradation due to grating lobes. Hence, an array of CCAS s realizes the full benefit of the CCAS concentration ratio, while achieving the directivity of a fully populated phased array.

Figure 27:
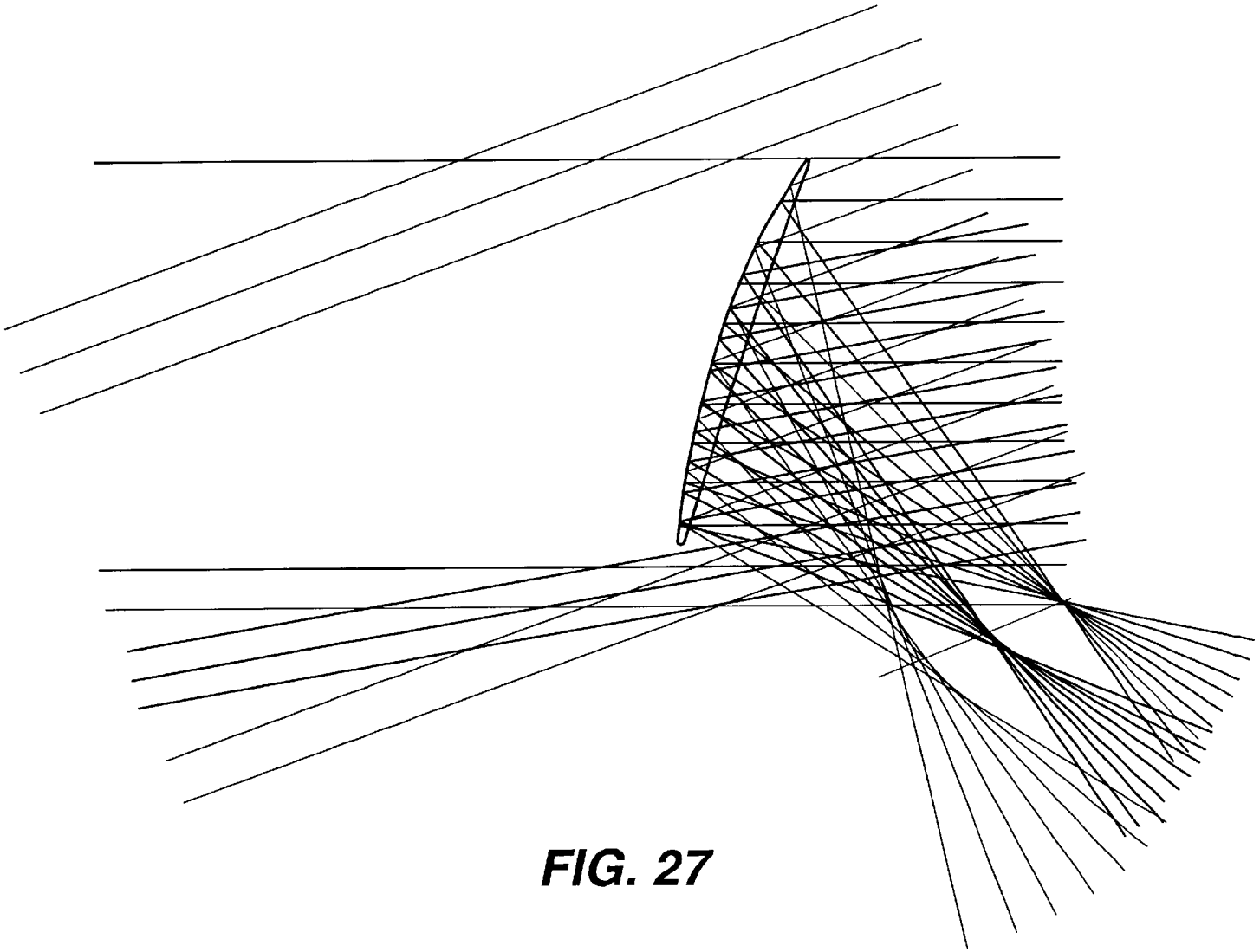
FIG. 27 diagrammatically represents EM radiation tracing for a doubly curved reflector scanning 0–20°.

A three-dimensional CCAS can be achieved in narrow band and wide band. A 1,000 square meter class aperture can be realized using a single large CCAS. The instantaneous bandwidth of such a CCAS using fixed feed weights is limited by the depth thereof, which also implies limited by the aperture size. A single CCAS with a 36 meter diameter is approximately 1200 wavelengths across at X-band. A three-dimensional CCAS of this size would have an estimated instantaneous bandwidth of 0.002% (approximately 200 kHZ). This limited bandwidth is unsuitable for many applications and to achieve wideband, a small CCAS is required. Such a relatively small CCAS does not have sufficient gain for many applications, such as space-based applications. An array of small CCASs may be used to obtain the high gain and wide bandwidth that are needed. A twenty $\lambda_0$ diameter CCAS was compared to a twenty $\lambda_0$ diameter offset parabolic reflector to determine which element would be more effective in an array. They were compared based on achievable feed area concentration and scan volume. A parabolic reflector cannot cover a scan volume much greater than ±10° before the feed array approaches the size of the reflector assembly itself. FIG. 27 shows a ray tracing for a doubly curved parabolic reflector scanning 0–20°, where the length of the feed array is 0.5 times the reflector diameter in the scan plane. In the orthogonal plane, ±10° scan volume requires a feed length approximately 0.4 times the reflector diameter. The area of the feed array is approximately 0.2 times the reflector area giving a concentration of 5. Thus, for the same sized feed as the CCAS, the parabolic element can be scanned over one quarter the objective scan volume. Another drawback of the parabolic reflector is that the offset feeding used to avoid blockage precludes the full aperture from being filled.

Figure 28:
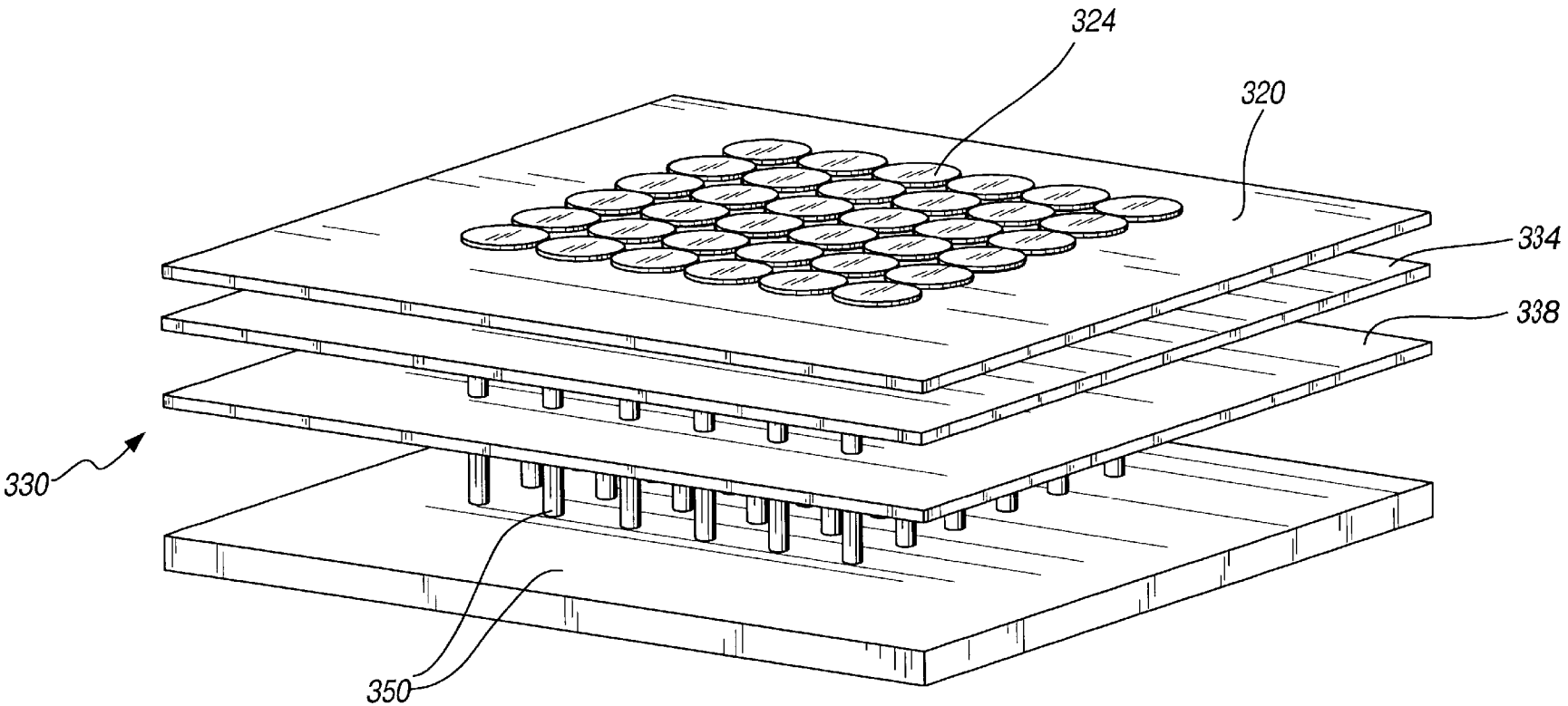
FIG. 28 diagrammatically illustrates one embodiment of an array of three-dimensional CCAS reflectors.

A number of three-dimensional CCASs can be utilized as part of providing an antenna array. A feed array with independent control of two orthogonal polarizations is required to feed each of the three-dimensional CCAS elements. One architecture for this feed is a dense array of dual-polarized elements mounted above a ground plane whose electrical path varies with frequency. Referring to FIG. 28, this antenna array includes the upper planar sheet or plate 320 having a top surface on which a number of the radiating CCAS elements 324 are positioned. A variable ground plane assembly 330 is spaced from the upper plate 320 and includes a number of ground planes 334, 338 that are joined and supported using a plurality of feed baluns 350. The dense packing of the radiating element lattice allows for broadband operation (9:1) without grating lobes or blindnesses over a large scan volume (±60°), and the variable depth ground plane construction allows the array antenna to operate efficiently over a large bandwidth. The total depth of the structure is $\lambda/4$ at the lowest frequency of operation.

An estimated 108 dual-polarized elements are needed to populate the feed array for the 20 $\lambda_0$ diameter three-dimensional CCAS elements array. Each such element requires independent variable phase and amplitude control for each polarization. This amounts to 216 variable LNAs (low noise amplifiers) and phase shifters for each such CCAS element. The complex EM feed distributions generated by the CCAS geometry requires a look-up table of amplitude and phase values for each element for each beam state. Based on a scan resolution of ⅓ of a beam width over 1 GHz bands for 2–18 GHz and allowing for eight-bit storage of each amplitude and phase value, the required storage can be determined. If the feed distributions are stored only for scanning in $\theta$ and then rotational displacements are calculated to scan in $\phi$, 164 kilobytes of storage are required. To store all beam states for ±22° scanned in both planes and avoid any calculation, 2.4 megabytes are needed. Since all CCAS elements in the array are controlled identically, 2.4 megabytes constitutes the total storage for the entire aperture.

The foregoing discussion of the present invention has been presented for purposes of illustration and description.

Furthermore, this discussion is not intended to limit the invention to the form disclosed herein. Consequently, variations and modifications commensurate with the above teachings, and the skill or knowledge of the relevant art, are within the scope of the present invention. The embodiments described hereinabove are further intended to explain best modes known for practicing the invention and to enable others skilled in the art to utilize the invention in such, or other, embodiments and with various modifications required by the particular applications or uses of the present invention. It is intended that the appended claims be construed to include alternative embodiments to the extent permitted by the prior art.

What is claimed is:

1. An antenna apparatus, comprising:

at least a first curved reflector section and a second curved reflector section that define a compound curve antenna structure;

a feed array including a plurality of feed elements comprising at least a first feed element in communication with said first and second curved reflector sections for use in providing at least one of a transmit beam and a return beam; and a control system communicating with said feed array for use in controlling said at least one of said transmit beam and said return beam, said control system including a memory storage for storing predetermined data related to controlling activation of said plurality of feed elements including at least said first feed element to provide a desired scan angle associated with said at least one of said transmit beam and said return beam;

wherein said return beam at said desired scan angle includes electromagnetic (EM) radiation reflected from said first curved reflector section to said feed array, EM radiation reflected from said second curved reflector section to said feed array and EM radiation directly incident on said feed array without first striking said first and second curved reflector sections.

2. An antenna apparatus, as claimed in claim 1, wherein:

said predetermined data relates to reference EM radiation of a reference beam striking at least one of: a first reference curved reflector; a second reference curved reflector; and a reference feed array directly without first striking said first and second reference curved reflectors.

3. An antenna apparatus, as claimed in claim 2, wherein:

said first curved reflector section is said first reference curved reflector and said second curved reflector section is said second curved reflector.

4. An antenna apparatus, as claimed in claim 1, wherein:

said compound curve antenna structure has an aperture end and a base end and in which each of said first and second curved reflector sections has a longitudinal extent extending between said aperture end and said base end, and in which said first curved reflector section is spaced from said second curved reflector section and with said feed array laterally extending therebetween, said feed array having a longitudinal extent defined between first and second ends thereof and with said first end being adjacent said base end of said first curved reflector section and said second end being adjacent said base end of said second curved reflector section.

5. An antenna apparatus, as claimed in claim 1, wherein:

said first and second curved reflector sections are located symmetrically about a reflector axis.

6. An antenna apparatus, as claimed in claim 1, wherein:

said compound curve antenna structure is two-dimensional having two focii and in which said two focii are located adjacent to opposite ends of said feed array.

7. An antenna apparatus, as claimed in claim 1, wherein:

said first and second curved reflector sections are part of a body of revolution such that said compound curved antenna structure is three-dimensional.

8. An antenna apparatus, as claimed in claim 1, wherein:

when said desired scan angle is substantially a maximum angle of scan for said transmit beam, substantially all feed elements that are energized are located adjacent to both an end of said feed array and an end of one of said first and second curved reflector sections.

9. An antenna apparatus, as claimed in claim 1, wherein:

the number of said feed elements that are energized becomes less as said desired scan angle increases towards a maximum angle of scan.

10. An antenna apparatus, as claimed in claim 1, wherein:

said transmit beam at said desired scan angle has EM radiation that strikes at least one of said first and second curved reflector sections which is less than one-half of the total of said EM radiation of said transmit beam for said desired scan angle.

11. An antenna apparatus, as claimed in claim 1, wherein:

said transmit beam is associated with a bandwidth and said bandwidth is related to the size of said compound curve antenna structure adjacent to said aperture end.

12. An antenna apparatus, as claimed in claim 1, wherein:

said desired scan angle is within a range of scan angles that includes a maximum angle of scan for said transmit beam and a greater number of said feed elements are energized to generate said transmit beam as said scan angle moves away from said maximum angle towards said desired scan angle.

13. An antenna apparatus, as claimed in claim 1, wherein:

a number of said plurality of said feed elements are energized for use in providing said transmit beam that has EM radiation and in which the identities of said number of feed elements that are energized depends on at least one of: density of said EM radiation and at least one path of said EM radiation associated with said desired scan angle for said transmit beam.

14. An antenna apparatus, comprising:

at least a first curved reflector section and a second curved reflector section that define a compound curve antenna structure;

a feed array including a plurality of feed elements comprising at least a first feed element in communication with said first and second curved reflector sections for use in generating an antenna beam that includes at least a transmit beam; and a control system communicating with said feed array for use in controlling generation of said transmit beam, said control system including a memory storage for storing predetermined data related to controlling activation of said plurality of feed elements including at least said first feed element to provide a desired scan angle associated with said transmit beam;

wherein said compound curve antenna structure is three-dimensional and has a property such that it operates in a dual-polarized mode using substantially the same number of said feed elements of said feed array as used when the antenna apparatus is a two-dimensional compound curve antenna structure for a same range of scan angles that includes said desired angle.

15. An antenna apparatus, comprising:

at least a first curved reflector section and a second curved reflector section that define a compound curve antenna structure;

a feed array including a plurality of feed elements comprising at least a first feed element in communication with said first and second curved reflector sections for use in generating an antenna beam that includes at least a transmit beam and a return beam and said compound curve antenna structure is three-dimensional, said return beam has a single linear polarization resulting from a dual-polarized feed provided during generation of said transmit beam; and a control system communicating with said feed array for use in controlling generation of said transmit beam, said control system including a memory storage for storing predetermined data related to controlling activation of said plurality of feed elements including at least said first feed element to provide a desired scan angle associated with said transmit beam.

16. An antenna apparatus, as claimed in claim 1, further including:

a plurality of said compound curved antenna structures arranged in an array.

17. An antenna apparatus, comprising:

at least a first curved reflector section and a second curved reflector section that define a compound curve antenna structure;

a feed array including a plurality of feed elements comprising at least a first feed element in communication with said first and second curved reflector sections for use in generating an antenna beam that includes at least a transmit beam, wherein said compound curve antenna structure is three-dimensional and said feed array independently controls two orthogonal polarizations in communicating with said three-dimensional compound curve antenna structure; and a control system communicating with said feed array for use in controlling generation of said transmit beam, said control system including a memory storage for storing predetermined data related to controlling activation of said plurality of feed elements including at least said first feed element to provide a desired scan angle associated with said transmit beam.

18. An antenna apparatus, comprising:

at least a first curved reflector section and a second curved reflector section that define a compound curve antenna structure, said compound curve antenna structure is three-dimensional and said predetermined data depends on a total amount of power associated with reflections using a reference return beam in a reference three-dimensional compound curve antenna structure;

a feed array including a plurality of feed elements comprising at least a first feed element in communication with said first and second curved reflector sections for use in generating an antenna beam that includes at least a transmit beam; and a control system communicating with said feed array for use in controlling generation of said transmit beam, said control system including a memory storage for storing predetermined data related to controlling activation of said plurality of feed elements including at least said first feed element to provide a desired scan angle associated with said transmit beam.

19. An antenna apparatus, as claimed in claim 1, wherein:

said feed elements are spaced between about $0.5\lambda$ and about $1\lambda$, while being operated using modulo $2\pi$ phase shifters.

20. An antenna apparatus, as claimed in claim 1, wherein:

an electrical size is related to a radiating aperture and said electrical size is in the range of about 10–500 wavelengths.

21. An antenna apparatus, as claimed in claim 1, wherein:

said curve is parabolic.

22. A method involving control of an antenna apparatus, comprising:

providing first and second curved reflector sections and a feed array, said first and second curved reflector sections together defining a first compound curve antenna structure having a reflector axis in which said first and second curved reflector sections are symmetrically located thereabout, said first compound curve antenna structure having an aperture end and a base end and with said feed array having a plurality of feed elements; and controlling activation of at least a first feed element of said plurality of feed elements to generate an antenna beam that is at least one of a transmit beam and a return beam using a control system and predetermined data that is stored in memory storage related to reflections on said first and second curved reflector sections and reflections that strike said feed array directly without first contacting said first compound curved antenna structure, wherein said return beam includes each of eletromagnetic (EM) radiation that is received by said first curved reflector section and reflected therefrom to said feed array, EM radiation that is received by said second curved reflector section and reflected therefrom to said feed array and EM radiation that is received directly by said feed array without first contacting said first compound curve antenna structure.

23. A method, as claimed in claim 22, wherein:

said antenna beam has a scan range associated with it, wherein said scan range includes at least a first angle and a maximum angle such that a greater number of said plurality of feed elements are activated when said antenna beam is at said maximum angle than when said antenna beam is at said first angle.

24. A method involving control of an antenna apparatus, comprising:

providing first and second curved reflector sections and a feed array, said first and second curved reflector sections together defining a first compound curve antenna structure having a reflector axis in which said first and second curved reflector sections are symmetrically located thereabout, said first compound curve antenna structure having an aperture end and a base end and with said feed array having a plurality of feed elements; and controlling activation of at least a first feed element of said plurality of feed elements to generate an antenna beam that is at least one of a transmit beam and a return beam using a control system and predetermined data that is stored in memory storage related to reflections on said first and second curved reflector sections and reflections that strike said feed array directly without first contacting said first compound curved antenna structure, said aperture end has an aperture size associated with it, said aperture size having a property that decreasing said aperture size increases bandwidth of said antenna beam.

25. A method, as claimed in claim 22, wherein:

said feed array has first and second ends and a center and, when said transmit beam is at said maximum angle, a substantial majority of said feed elements that are activated are located at least at one of said ends of said feed array and substantially no feed elements are activated at said center of said feed array.

26. A method, as claimed in claim 22, further including:

obtaining said predetermined data using a reference beam having EM radiation applied to a reference compound curve antenna structure at a number of scan angles and monitoring locations that said EM radiation strikes said reference compound curve antenna structure and a reference feed array communicating therewith.

27. A method, as claimed in claim 22, further including:

providing a number of compound curve antenna structures including said first compound curve antenna structure and with said number of compound curve antenna structures depending on a bandwidth associated with said antenna beam to be produced using said controlling step.

28. A method, as claimed in claim 22, wherein:

said first compound curve antenna structure is one of: (i) a two-dimensional compound curve antenna structure and (ii) a three-dimensional compound curve antenna structure and in which said two-dimensional compound curve antenna structure has two focii that are located adjacent to opposite ends of said feed array.

29. A method involving control of an antenna apparatus, comprising:

providing first and second curved reflector sections and a feed array, said first and second curved reflector sections together defining a first compound curve antenna structure having a reflector axis in which said first and second curved reflector sections are symmetrically located thereabout, said first compound curve antenna structure having an aperture end and a base end and with said feed array having a plurality of feed elements, said first compound curve antenna structure is a three-dimensional compound curve antenna structure; and controlling activation of at least a first feed element of said plurality of feed elements to generate an antenna beam that is at least one of a transmit beam and a return beam using a control system and predetermined data that is stored in memory storage related to reflections on said first and second curved reflector sections and reflections that strike said feed array directly without first contacting said first compound curve antenna structure, and said controlling includes independently controlling two orthogonal polarizations in communicating with said first three-dimensional compound curve antenna structure.

30. A method, as claimed in claim 29, further including:

providing a plurality of three-dimensional compound curve antenna structures an having said plurality of three-dimensional compound curve antenna structures arranged according to an array.

31. A method, as claimed in claim 26, wherein:

said first compound curve antenna structure is three-dimensional and said monitoring includes determining the contribution of power by each of said EM radiation to a total power collected using said reference feed array in ascertaining whether power contributed by a last one of said EM radiation is less than a predetermined amount of said total power.

32. An antenna apparatus, comprising:

at least a first curved reflector section and a second curved reflector section that define a compound curve antenna structure, each of said first and second curved reflector sections has a longitudinal extent and with the first curved reflector section being spaced from the second curved reflector section, said compound curve antenna structure including said first and second curved reflector sections has an aperture end and base end;

a feed array including a plurality of feed elements comprising at least a first feed element in communication with said first and second curved reflector sections for use in providing at least one of a transmit beam and a return beam, said feed array having a longitudinal extent and first and second ends at opposite ends of said longitudinal extent, said first end being more adjacent said base end of said first curved reflector section than to said aperture end thereof and said second end being more adjacent to said base end of said second curved reflector section than to said aperture end thereof; and a control system communicating with said feed array for use in controlling at least one of said transmit beam and said return beam, said control system including a memory storage for storing predetermined data related to controlling activation of said plurality of feed elements including at least said first feed element to provide a desired scan angle associated with said at least one of said transmit beam and said return beam.

* * * * *